US010155575B2

(12) United States Patent
Kehr

(10) Patent No.: US 10,155,575 B2
(45) Date of Patent: Dec. 18, 2018

(54) DIFFUSER-TYPE ENDPLATE PROPELLER

(71) Applicant: Young-Zehr Kehr, Keelung (TW)

(72) Inventor: Young-Zehr Kehr, Keelung (TW)

(73) Assignee: National Taiwan Ocean University, Keelung (TW)

( * ) Notice: Subject to any disclaimer, the term of this patent is extended or adjusted under 35 U.S.C. 154(b) by 0 days.

(21) Appl. No.: 15/860,685

(22) Filed: Jan. 3, 2018

(65) Prior Publication Data

US 2018/0127074 A1 May 10, 2018

Related U.S. Application Data

(63) Continuation-in-part of application No. 14/151,827, filed on Jan. 10, 2014, now abandoned.

(30) Foreign Application Priority Data

Jun. 7, 2013 (TW) ..... 102120356 A

(51) Int. Cl.
*B63H 1/15* (2006.01)
*B63H 1/16* (2006.01)
(Continued)

(52) U.S. Cl.
CPC ..... *B63H 1/26* (2013.01); *B63H 1/15* (2013.01); *B63H 1/16* (2013.01); *B63H 1/18* (2013.01); *B63H 1/20* (2013.01); *B63B 2748/00* (2013.01)

(58) Field of Classification Search
CPC ... B63H 1/15; B63H 1/18; B63H 1/26; B63H 1/16; B63H 1/14
(Continued)

(56) References Cited

U.S. PATENT DOCUMENTS 698,582 A 4/1902 Strothman
1,117,103 A 11/1914 Steinbach
(Continued)

FOREIGN PATENT DOCUMENTS

CN 2389840 8/2000
CN 101300169 6/2011
(Continued)

OTHER PUBLICATIONS

K. De Jong, "On the Design of Optimum Ship Screw Propellers, Including Propellers With End Plates," International Symposium on Propulsors and Cavitation, Jun. 1992, pp. 1-9.
(Continued)

*Primary Examiner* — Christopher Verdier
(74) *Attorney, Agent, or Firm* — JCIPRNET

(57) ABSTRACT

A diffuser-type endplate propeller driving a hull and including a propeller hub and a plurality of blades is provided. The propeller hub has an axis of rotation and is connected to a transmission shaft of the hull. A blade has a blade-body and an endplate. The blade-body is connected to the propeller hub and extends outward from the propeller hub to the corresponding endplate, the endplate bends from the corresponding blade-body to extend towards a stern of the hull, and the endplate has a leading edge and a trailing edge. A cylindrical surface is imaginarily formed by the leading edges while the diffuser-type endplate propeller is rotated about the axis. Each of the endplates has a first tangent plane at the leading edge thereof, the cylindrical surface has a second tangent plane at the leading edge. An included angle is measured from the second tangent plane to the first tangent plane.

16 Claims, 21 Drawing Sheets

(51) Int. Cl.
*B63H 1/18* (2006.01)
*B63H 1/26* (2006.01)
*B63H 1/20* (2006.01)

(58) Field of Classification Search
USPC ..... 416/191, 192, 195, 228, 235, 236 R, 416/236 A, 237; 440/49, 66, 68, 69
See application file for complete search history.

(56) References Cited

U.S. PATENT DOCUMENTS

| | | | | |
|---|---|---|---|---|
| 1,597,175 | A | 8/1926 | Boening | |
| 2,099,229 | A | 11/1937 | Possenheim | |
| 2,426,742 | A * | 9/1947 | Pawlowski | B63H 1/16 416/189 |
| 2,498,170 | A * | 2/1950 | Meier | B63H 1/28 416/236 A |
| 4,130,378 | A * | 12/1978 | Eichler | B63H 1/14 416/175 |
| 4,288,223 | A * | 9/1981 | Gonzalez | B63H 5/16 440/71 |
| 4,300,889 | A | 11/1981 | Wormser | |
| 4,443,202 | A | 4/1984 | Arena | |
| 4,632,636 | A | 12/1986 | Smith | |
| 5,205,765 | A | 4/1993 | Holden | |
| 6,352,408 | B1 * | 3/2002 | Kilian | B63H 1/14 416/191 |
| 9,021,970 | B2 | 5/2015 | Kawakita | |
| 2009/0110559 | A1 | 4/2009 | Bell et al. | |
| 2009/0226323 | A1 | 9/2009 | Suzuki | |
| 2011/0217177 | A1 | 9/2011 | Rolla | |

FOREIGN PATENT DOCUMENTS

| | | |
|---|---|---|
| CN | 01863306 | 1/2012 |
| CN | 102958800 | 3/2013 |
| CN | 103121502 | 5/2013 |
| DE | 1781084 | 2/1971 |
| EP | 0300683 | 1/1989 |
| EP | 1260432 | 11/2002 |
| JP | S58194689 | 11/1983 |
| JP | S60004878 | 2/1985 |
| KR | 1020120132082 | 12/2012 |
| KR | 101259704 | 5/2013 |
| TW | M293210 | 7/2006 |
| WO | 2010138073 | 12/2010 |
| WO | 2012053378 | 4/2012 |

OTHER PUBLICATIONS

Mariano Pérez Sobrino, et al, "Scale Effects in Model Tests With CLT Propellers," 27th Motor Ship Marine Propulsion Conference, Jan. 2005, pp. 1-27.

* cited by examiner

DIFFUSER-TYPE ENDPLATE PROPELLER

CROSS-REFERENCE TO RELATED APPLICATION

This application is a continuation-in-part application of and claims the priority benefit of U.S. application Ser. No. 14/151,827, filed on Jan. 10, 2014, now abandoned, which claims the priority benefit of Taiwan application serial no. 102120356, filed on Jun. 7, 2013. The entirety of each of the above-mentioned patent applications is hereby incorporated by reference herein and made a part of this specification.

BACKGROUND OF THE INVENTION

Field of the Invention

The present invention generally relates to a propeller, and more particularly, to a diffuser-type endplate propeller.

Description of Related Art

Most of the current ships use propellers to drive fluid to produce sail powers. Specifically, when a propeller blade rotates, there is a pressure difference existing between a high-pressure side-surface and a low-pressure side-surface of the propeller blade, and the pressure difference forms a thrust to make the ship proceed on the water surface.

Among various current designs of the endplate propeller, the following two types are more common: tip vortex free (TVF) propeller and contracted loaded tip (CLT) propeller. For the TVF propeller, the endplate thereof is tangential to the cylindrical surface of the propeller blade-tip. That is during the rotation of the propeller, the endplate becomes a portion of the cylindrical surface to reduce the viscous resistance of the endplate. However, when fluid passes through a general propeller, it would produce contracted wake flows at the blade-tips, so that the successive developers further make the endplate contracted by design, i.e., for the new designed CLT propeller, the leading edge radius of the endplate is greater than the radius of the trailing edge. It should be noted that both the TVF propeller and the CLT propeller are able to effectively prevent the fluid at the high-pressure side-surfaces of the propeller blades from flowing to the low-pressure side-surfaces so as to keep the loads of the blade-tips and suppress the intensity of the tip vortex. Accordingly, a portion of the thrust produced by the above-mentioned TVF propeller or CLT propeller is provided by the high-pressure side-surfaces of the propeller blades, which reduces the probability for the low-pressure side-surface of the propeller to produce cavitation.

In fact, however, it is found when the CLT propeller rotates under the uniform inflow condition, the sheet cavitation phenomenon is always produced at the outer-sides of the endplate regardless of a propeller blade turning to any circumferential position so as to rise up the resistance on the endplate and reduce the efficiency of the propeller. As a result, it may generate the hull vibration and noise. Obviously, it is quite unhelpful for a low-vibration and low-noise design of ship. Another more serious trouble is that if a CLT propeller is applied to a hull based on the inclined-shaft design, for example, a speedboat, the CLT propeller under an inclined-shaft inflow condition has a more serious cavitation phenomenon occurred at the endplate of a blade when the blade turns to the upper-vertical position.

SUMMARY OF THE INVENTION

Accordingly, the present invention is directed to a diffuser-type endplate propeller under an inclined-shaft inflow condition which can largely reduce even eliminate the sheet cavitation phenomenon produced by the endplate itself regardless of the propeller blades turning to any angle positions.

An embodiment of the present invention provides a diffuser-type endplate propeller, configured to drive a hull and including a propeller hub and a plurality of blades. The propeller hub has an axis of rotation of the diffuser-type endplate propeller and is connected to a transmission shaft of the hull. The blades respectively have a blade-body and an endplate, each of the blade-bodies is connected to the propeller hub and extends outward from the propeller hub to the corresponding endplate, each of the endplates bends from the corresponding blade-body to extend towards a stern of the hull, each of the endplates has a leading edge and a trailing edge. A cylindrical surface is imaginarily formed by the leading edges while the diffuser-type endplate propeller is rotated about the axis wherein each of the endplates has a first tangent plane at the leading edge thereof, the cylindrical surface has a second tangent plane at the leading edge. While viewing from a high-pressure side of the diffuser-type endplate propeller, the diffuser-type endplate propeller rotates clockwise to drive the hull for proceeding towards a sailing direction, and an included angle between the first tangent plane and the second tangent plane is a negative angle measured from the second tangent plane to the first tangent plane.

An embodiment of the present invention provides a diffuser-type endplate propeller, configured to drive a hull and including a propeller hub and a plurality of blades. The propeller hub has an axis of rotation of the diffuser-type endplate propeller and is connected to a transmission shaft of the hull. The blades respectively have a blade-body and an endplate, each of the blade-bodies is connected to the propeller hub and extends outward from the propeller hub to the corresponding endplate, each of the endplates bends from the corresponding blade-body to extend towards a stern of the hull, each of the endplates has a leading edge and a trailing edge. A cylindrical surface is imaginarily formed by the leading edges while the diffuser-type endplate propeller is rotated about the axis wherein each of the endplates has a first tangent plane at the leading edge thereof, the cylindrical surface has a second tangent plane at the leading edge. While viewing from a high-pressure side of the diffuser-type endplate propeller, the diffuser-type endplate propeller rotates counterclockwise to drive the hull for proceeding towards a sailing direction, and an included angle between the first tangent plane and the second tangent plane is a positive angle measured from the second tangent plane to the first tangent plane.

Based on the depiction above, since the endplate propeller of the invention is a diffuser-type endplate propeller, i.e., when the diffuser-type endplate propeller is rotating, it does not produce sheet cavitation phenomenon at the endplates themselves, so that the invention improves the efficiency of the endplate propeller and reduces the hull vibration and noise.

In order to make the features and advantages of the present invention more comprehensible, the present invention is further described in detail in the following with reference to the embodiments and the accompanying drawings.

DESCRIPTION OF THE EMBODIMENTS

In the following, the depicted embodiments together with the included drawings are intended to explain the feasibility of the present invention, wherein for better understanding and clear illustrating, the proportions or the angles between parts are amplified or shrunk appropriately so that the proportions or the angles herein are to describe, not to limit, the present invention.

Figure 1:
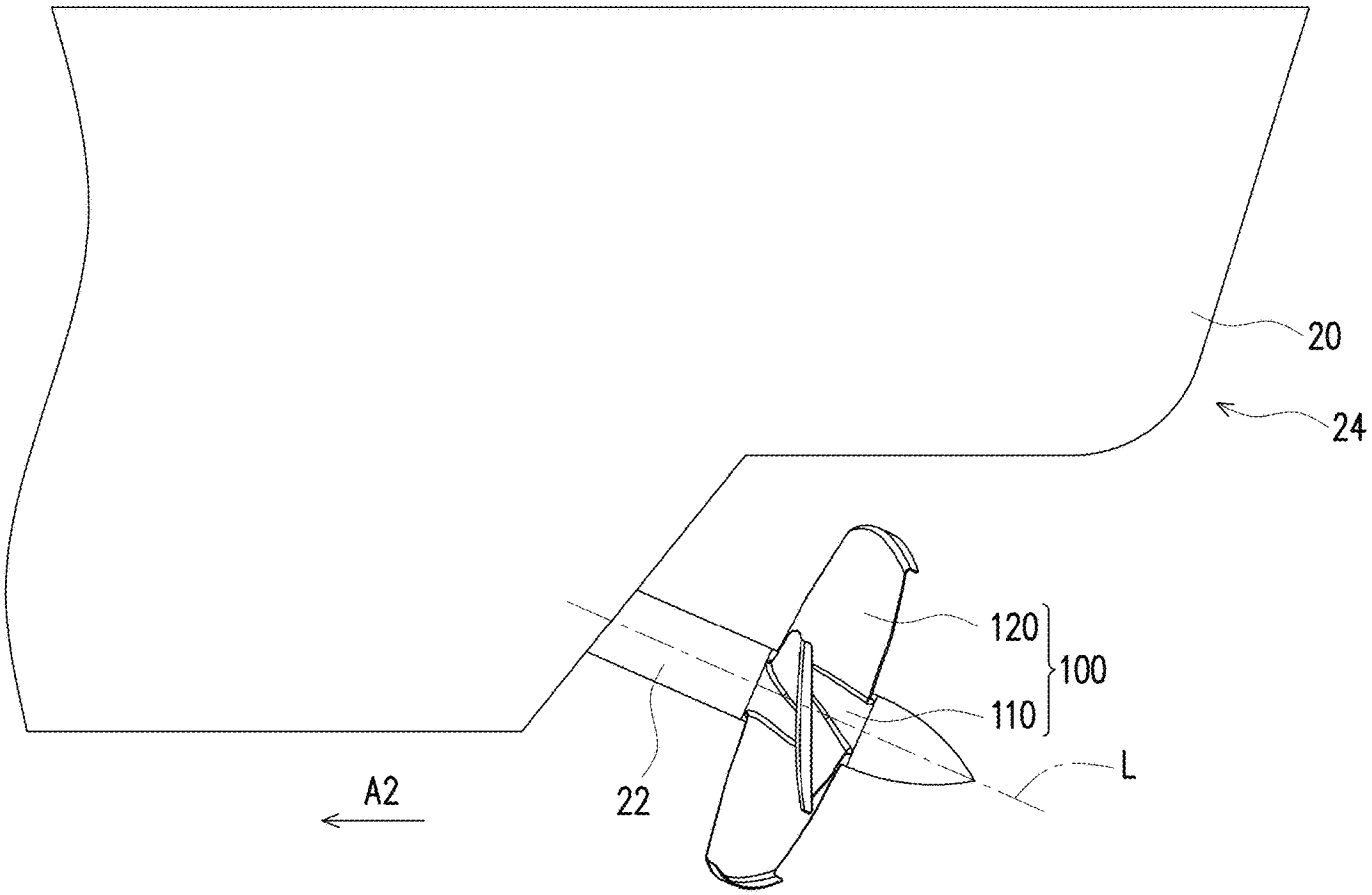
FIG. 1 is a schematic partial diagram showing a diffuser-type endplate propeller connected to a hull in an embodiment of the invention.
Figure 2:
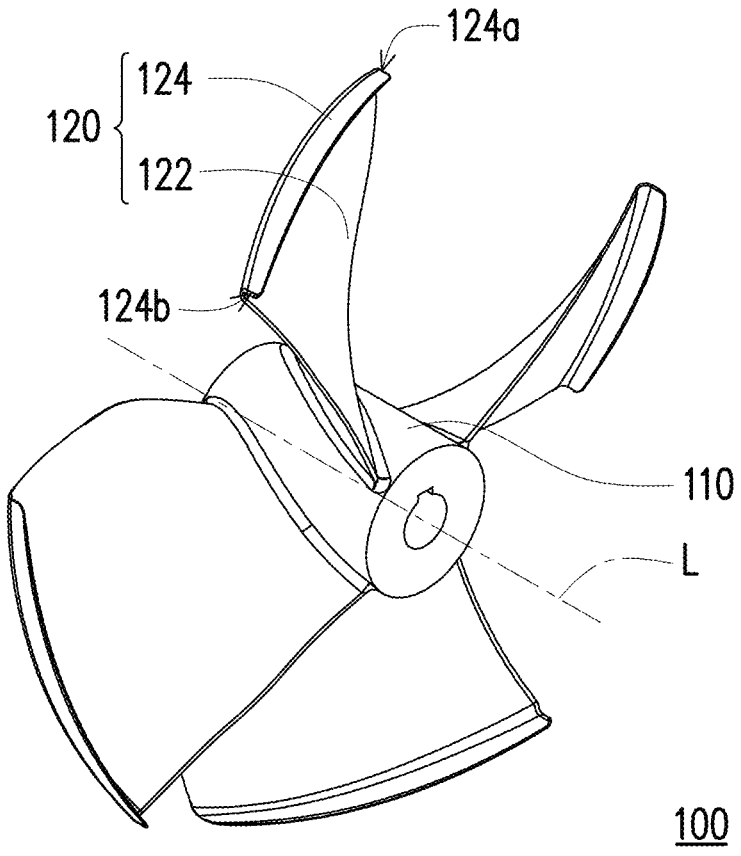
FIG. 2 is a three-dimensional diagram of the diffuser-type endplate propeller of FIG. 1.
Figure 3A:
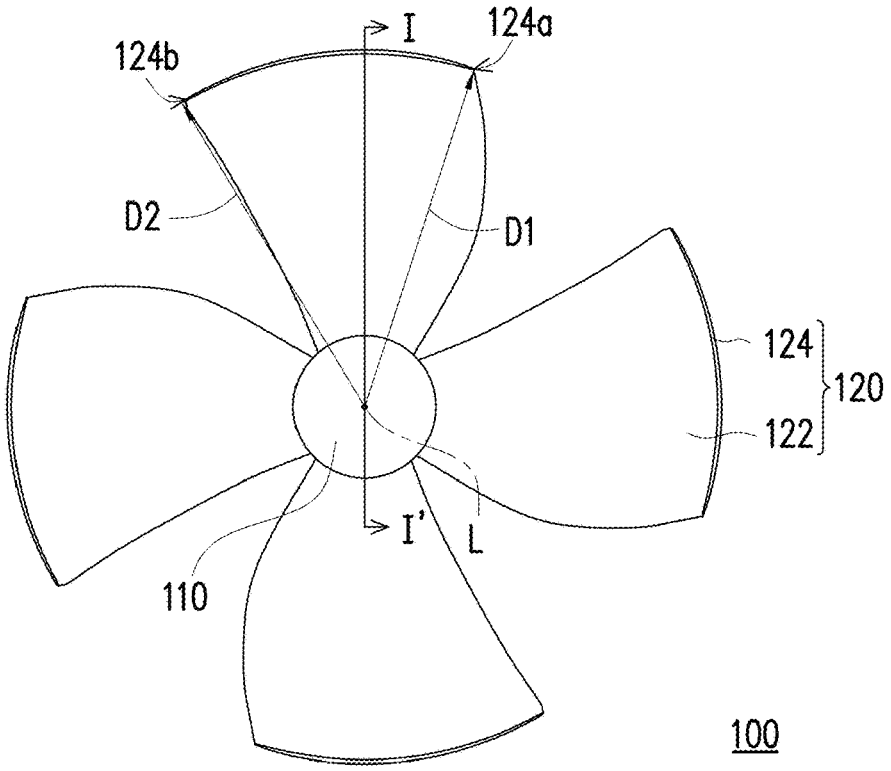
FIG. 3A is a front-view diagram of the diffuser-type endplate propeller in FIG. 1 in the angle of view towards the stern of the hull.
Figure 3B:
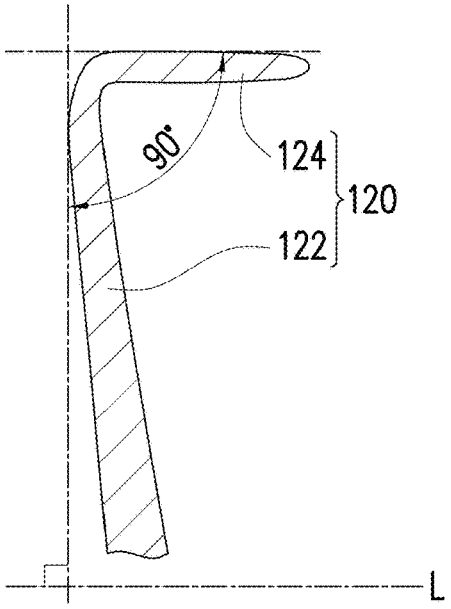
FIG. 3B is a cross-sectional view along the section line I-I' of the diffuser-type endplate propeller in FIG. 3A.

FIG. 1 is a schematic partial diagram showing a diffuser-type endplate propeller connected to a hull in an embodiment of the invention, FIG. 2 is a three-dimensional diagram of the diffuser-type endplate propeller of FIG. 1, FIG. 3A is a front-view diagram of the diffuser-type endplate propeller in FIG. 1 in the angle of view towards the stern of the hull, and FIG. 3B is a cross-sectional view along the section line I-I' of the diffuser-type endplate propeller in FIG. 3A. Referring to FIGS. 1-3B, a diffuser-type endplate propeller 100 of the embodiment is able to drive a hull 20, and the diffuser-type endplate propeller 100 includes a propeller hub 110 and a plurality of blades 120. The propeller hub 110 is connected to a transmission shaft 22 of the hull 20. Each of the blades 120 respectively has a blade-body 122 and a endplate 124 connected to each other, in which each blade-body 122 is connected to the propeller hub 110 and extends outward from the propeller hub 110 to the corresponding endplate 124, and each endplate 124 bends from the corresponding blade-body 122 to extend towards a stern 24 of the hull. Each endplate 124 has a leading edge 124*a* and a trailing edge 124*b*, in which the leading edge 124*a* keeps a first distance D1 from an axis L of the propeller hub 110, the trailing edge 124*b* keeps a second distance D2 from the axis L of the propeller hub 110, and the first distance D1 is shorter than the second distance D2. However, the endplate 124 is parallel to the axis L, as shown in FIG. 3B.

The diffuser-type endplate propeller 100 of the embodiment is installed, for example, at the bottom of the hull 20 and operated under an inclined-shaft condition or a horizontal shaft condition. The diffuser-type endplate propeller 100 is described as operated under an inclined-shaft condition for illustration purpose. In more details, the diffuser-type endplate propeller 100 is connected to an end of the transmission shaft 22 through the propeller hub 110, while another end of the transmission shaft 22 is connected to the engine in the hull 20 (not shown). When the engine is running, the transmission shaft 22 is driven to rotate the diffuser-type endplate propeller 100, and, by means of the rotating of the blades 120, the water flow is pushed back towards the stern 24 so as to produce a forward reaction for driving the hull 20 to proceed in a sailing direction A2, in which the axis L of the propeller hub 110 is not parallel to the sailing direction A2.

In general, the quantity of the blades 120 is three to seven. In the embodiment, there are, for example, four blades 120, which are disposed and radially arranged on the propeller hub 110. On the other hand, the diffuser-type endplate propeller 100 is fabricated in, for example, a casting process by using metallic material or composite materials. In other words, the propeller hub 110 and the blades 120 can be integrally molded to have better rigidity to withstand the pressure of the water flow.

Continuing to FIGS. 1 and 2, the blade-body 122 of a blade 120 can further include a high-pressure side-surface towards the stern 24 and a low-pressure side-surface back from the stern 24, in which the most portion of the thrust produced by the diffuser-type endplate propeller 100 is provided by the high-pressure side-surface. Similar to conventional technology, it should be noted that since the diffuser-type endplate propeller 100 in the embodiment, for example, rotates clockwise and the endplates 124 can prevent the water flow moved by the rotations of the blades 120 from flowing to the low-pressure side-surfaces at the blade-tips so as to ensure the diffuser-type endplate propeller 100 having good efficiency and effectively suppress the tip vortex.

In the embodiment, the leading edge 124*a* is, for example, for guiding the water flow of the high-pressure side-surface of the propeller to flow to the trailing edge 124*b* along the inner-side of the endplate 124, and then, guiding the water flow out of the high-pressure side-surface through the trailing edge 124*b*. In more details, the endplate 124 of the embodiment chordwise extends to the trailing edge 124*b* from the leading edge 124*a*, in which the leading edge 124*a* keeps a first distance D1 from the axis L, the trailing edge 124*b* keeps a second distance D2 from the axis L, and the first distance D1 is shorter than the second distance D2, and further thus, the endplate 124 has a diffused shape chordwise.

Figure 4A:
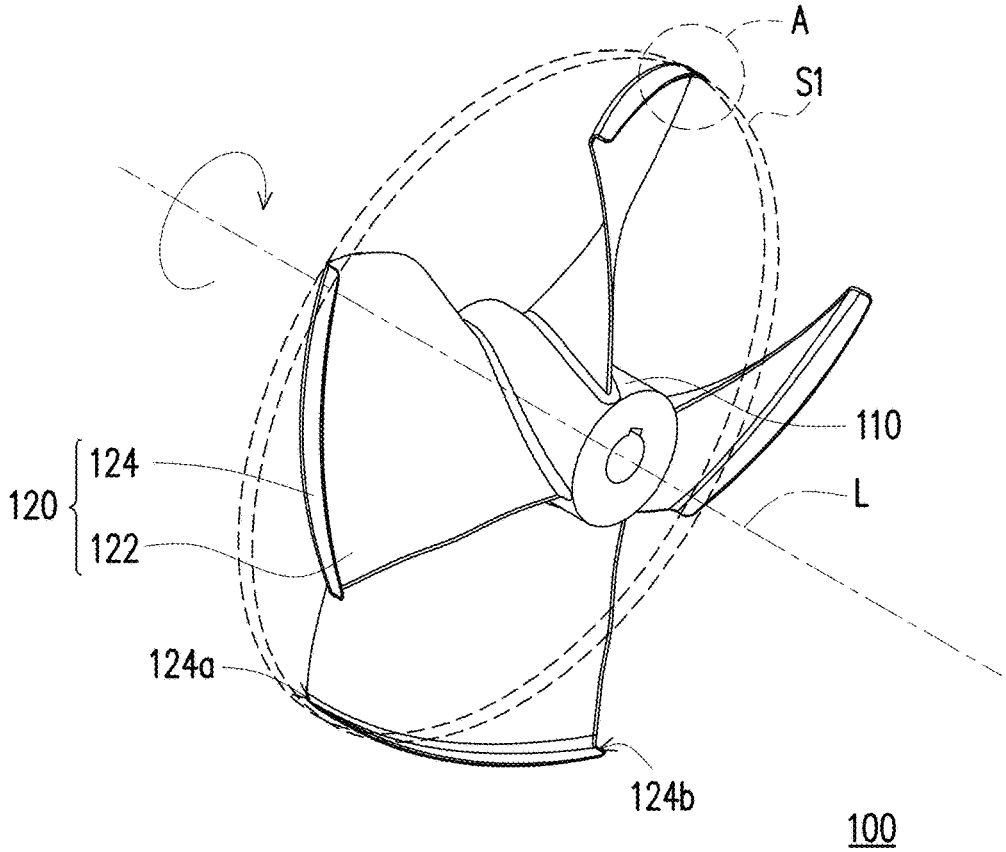
FIG. 4A is a diagram showing the diffuser-type endplate propeller of FIG. 2 in clockwise rotating.
Figure 4B:
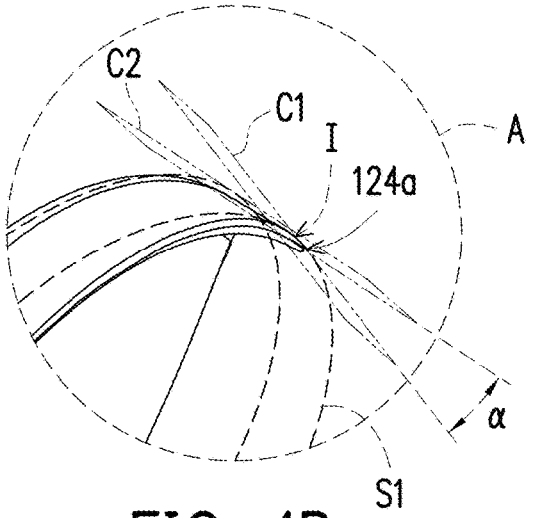
FIG. 4B is a partial enlarged view diagram of a region A of the diffuser-type endplate propeller of FIG. 4A.
Figure 4C:
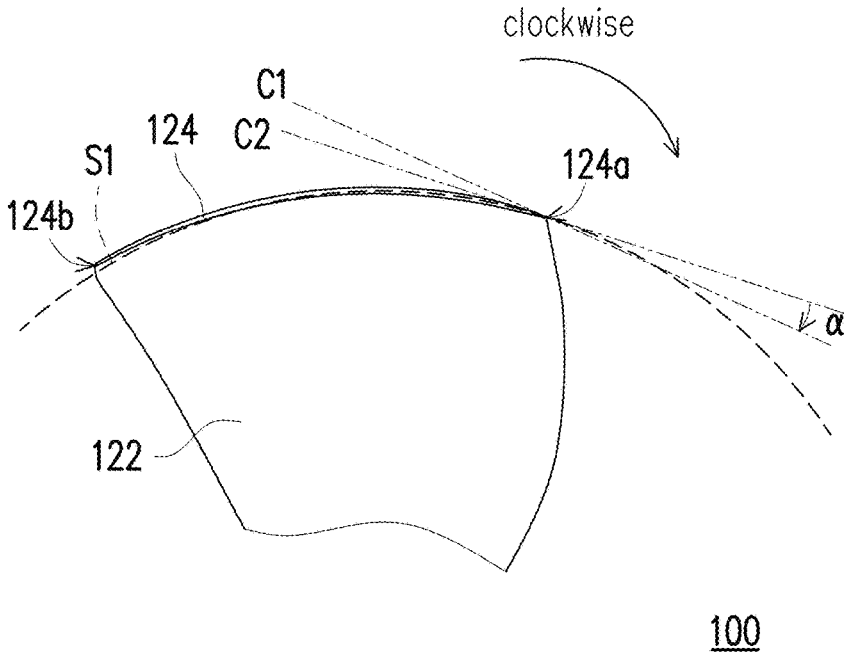
FIG. 4C is a partial enlarged view diagram of the region A of the diffuser-type endplate propeller of FIG. 4A in view along an axis of the propeller from a high pressure side.

FIG. 4A is a diagram showing the diffuser-type endplate propeller of FIG. 2 in clockwise rotating, and FIG. 4B is a partial enlarged view diagram of a region A of the diffuser-type endplate propeller of FIG. 4A, and FIG. 4C is a partial enlarged view diagram of the region A of the diffuser-type endplate propeller of FIG. 4A in view along an axis of the propeller from a high pressure side. Referring to FIGS. 4A and 4B, when the diffuser-type endplate propeller 100 rotates clockwise, the rotating track of the leading edge 124*a* forms a cylindrical surface S1, and a negative angle of attack of endplate (the diffuser angle) $\alpha$ may present at the leading edge 124*a* of each endplate 124. However, the invention is not limited thereto, the negative angle of attack of endplate may be determined at other appropriate positions on the endplate 124 in other embodiments. More specifically, in the present embodiment, the leading edge 124*a* and the cylindrical surface S1 has a boundary line I, the endplate 124 has a first tangent plane C1 which is located at the boundary line I and along the chord of the endplate 124, while the cylindrical surface S1 has a second tangent plane C2 on the boundary line I, the included angle of the first tangent plane C1 and the second tangent plane C2 is the angle of attack of endplate $\alpha$. In the embodiment, the angle of attack of endplate $\alpha$ is, for example, smaller than 0° and greater than or equal to −1°, which means the endplate 124 of the embodiment has a negative angle of attack.

In other words, the cylindrical surface S1 is an imaginary surface formed by the leading edge 124*a* while the endplates 124/the diffuser-type endplate propeller 10 is rotated about the axis L of the propeller hub 110, the boundary line I is an intersection line between the leading edge 124*a* and the cylindrical surface S1, and thus the boundary line I is located on the cylindrical surface S1 and coincide with the leading edge 124*a*. The first tangent plane C1 is tangential to the endplate 124 at the leading edge 124*a* (or the boundary line I). That is, the first tangent plane C1 contains the leading edge 124*a* and is a tangent plane of the endplate 124. In addition, the second tangent plane C2 is tangential to the cylindrical surface S1 at the leading edge 124*a*. That is, the second tangent plane C2 contains the leading edge 124*a* and is a tangent plane of the cylindrical surface S1. The angle of attack of endplate $\alpha$ is defined as the included angle of the first tangent plane C1 and the second tangent plane C2. The absolute value of the included angle is greater than 0° and smaller than or equal to 10 in the invention.

FIG. 4C is a partial enlarged view diagram of the region A of the diffuser-type endplate propeller of FIG. 4A in view along an axis of the propeller from a high pressure side. Referring to FIG. 4A, while viewing from the high-pressure side of the diffuser-type endplate propeller 100, the diffuser-type endplate propeller 100 rotates clockwise to drive the hull 20 for proceeding towards the sailing direction A2. The included angle between the first tangent plane C1 and the second tangent plane C2 is measured from the second tangent plane C2 to the first tangent plane C1 in clockwise direction, so the included angle is a negative angle. To be more specific, the included angle is greater than or equal to −1° and smaller than 0°, and thus the angle of attack of endplate $\alpha$ is also greater than or equal to −1° and smaller than 0°.

Figure 4D:
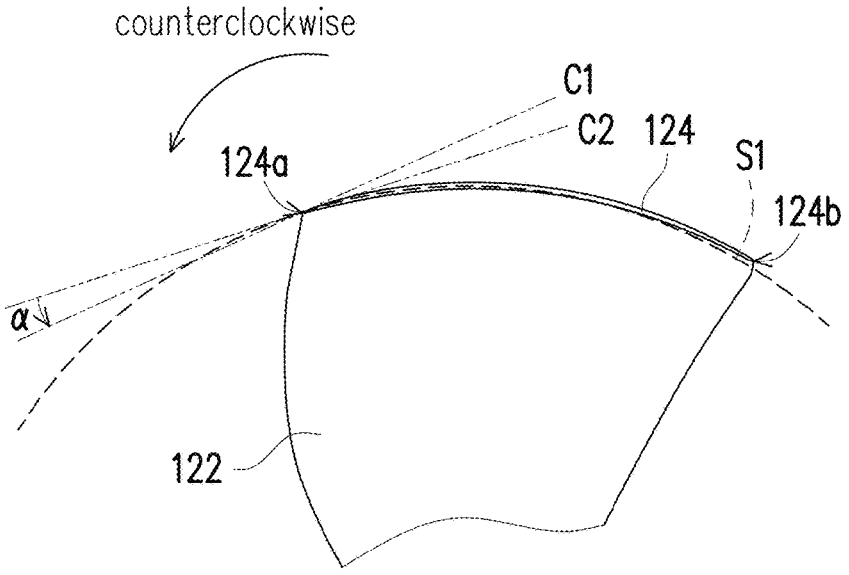
FIG. 4D is a partial enlarged view diagram of the region A of the diffuser-type endplate propeller of another embodiment of the invention for counter-clockwise rotating in view along an axis of the propeller from a high pressure side.

FIG. 4D is a partial enlarged view diagram of the region A of the diffuser-type endplate propeller of another embodiment of the invention in view along an axis of the propeller from a high pressure side. Referring to FIG. 4D, in the present embodiment, while viewing from the high-pressure side of the diffuser-type endplate propeller 100, the diffuser-type endplate propeller 100 rotates counterclockwise to drive the hull 20 for proceeding towards the sailing direction A2. The included angle between the first tangent plane C1 and the second tangent plane C2 is measured from the second tangent plane C2 to the first tangent plane C1 in counterclockwise direction, so the included angle is a positive angle. To be more specific, the included angle is greater than 0° and smaller than or equal to 1°, and thus the angle of attack of endplate $\alpha$ is also greater than 0° and smaller than or equal to 1°.

Figure 5A:
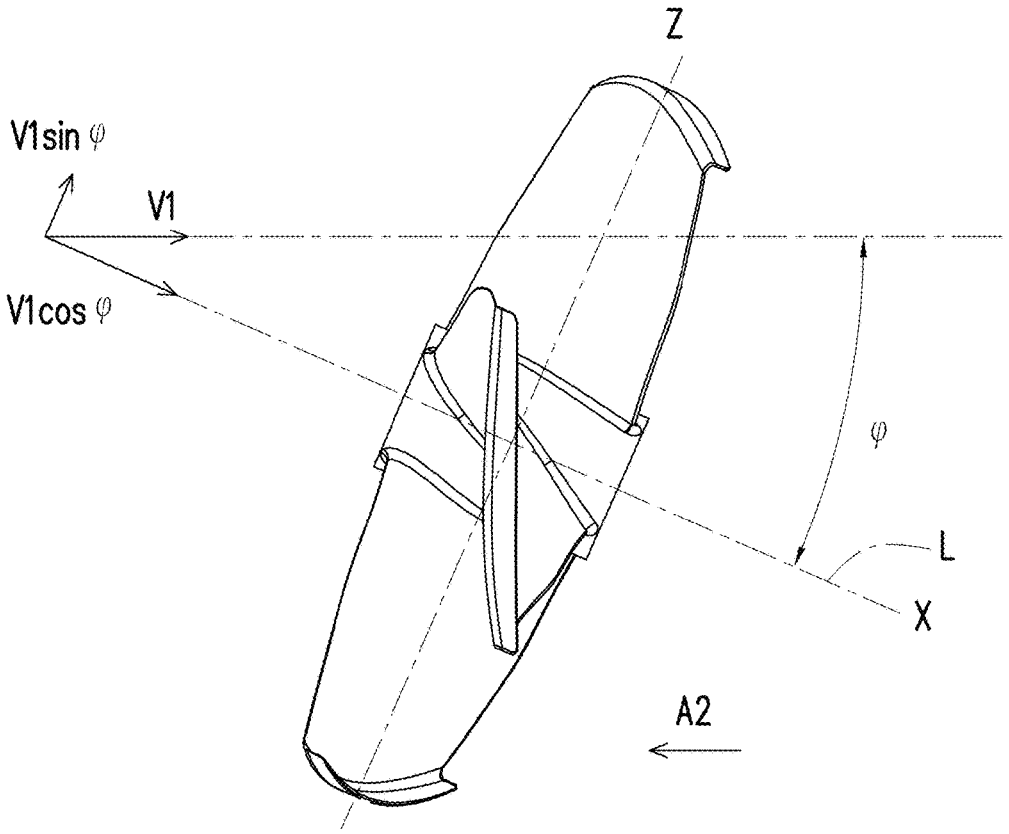
FIG. 5A is a diagram showing the inflow velocity at the inclined-shaft for the diffuser-type endplate propeller of FIG. 1.
Figure 5B:
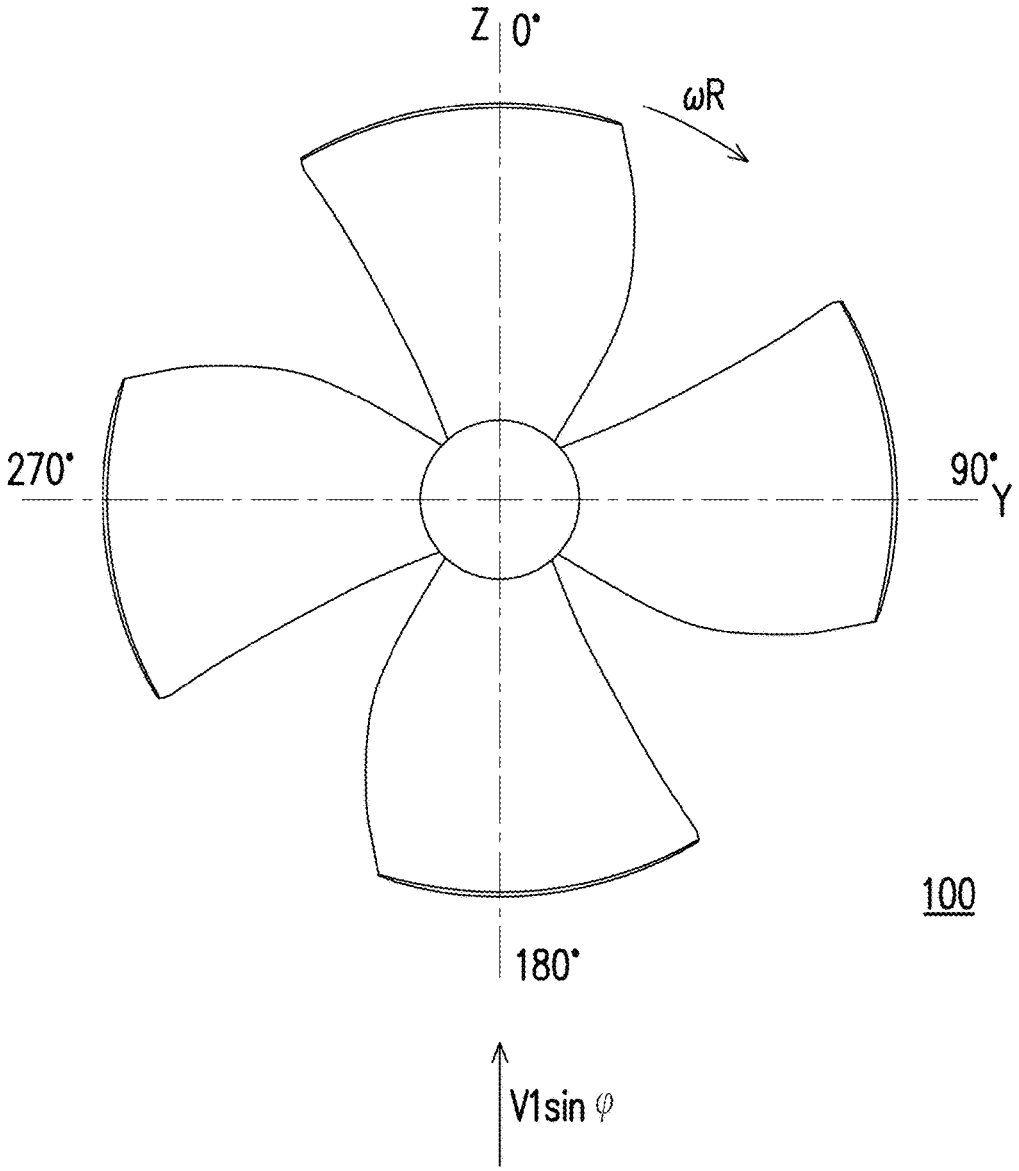
FIG. 5B is a diagram showing the diffuser-type endplate propeller of FIG. 5A in clockwise rotating along the X axis while viewing from the high pressure side.
Figure 5C:
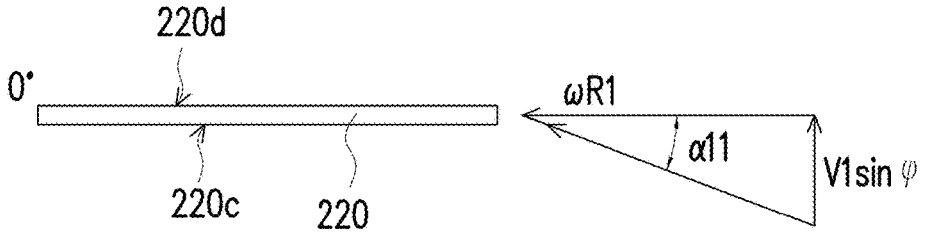
FIG. 5C (RELATED ART)
FIG. 5C is a diagram showing the inflow velocity at the cylindrical endplate for a conventional propeller without diffuser-type endplate under an inclined-shaft inflow condition, wherein the propeller turns to the 0° circumferential position.
Figure 5D:
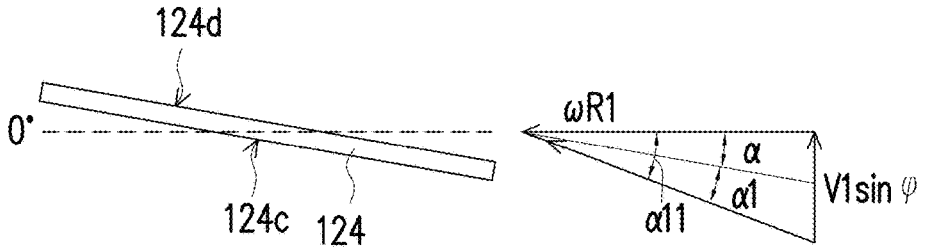
FIG. 5D is a diagram showing the inflow velocity at the endplate for the diffuser-type endplate propeller of FIG. 5A, wherein the propeller turns to the 0° circumferential position.
Figure 5E:
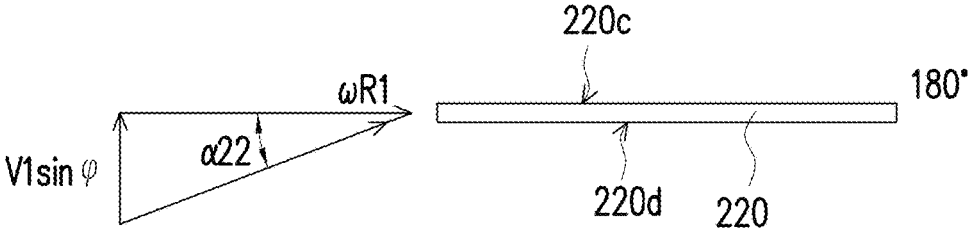
FIG. 5E (RELATED ART)
FIG. 5E is a diagram showing the inflow velocity at the cylindrical endplate for a conventional propeller under an inclined-shaft inflow condition, wherein the propeller turns to the 180° circumferential position.
Figure 5F:
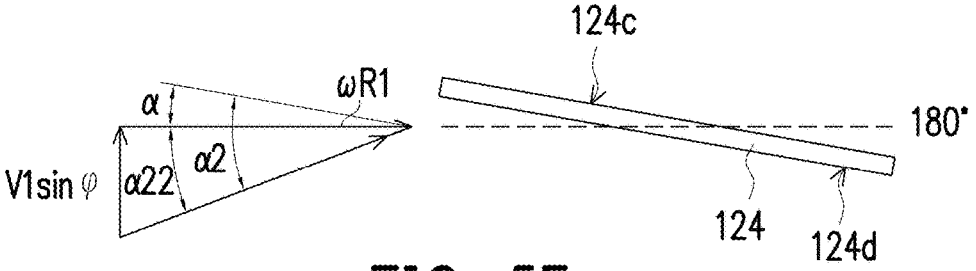
FIG. 5F is a diagram showing the inflow velocity at the endplate for the diffuser-type endplate propeller of FIG. 5A, wherein the propeller turns to the 180° circumferential position.

FIG. 5A is a diagram showing the inflow velocity at the inclined-shaft for the diffuser-type endplate propeller of FIG. 1. FIG. 5B is a diagram showing the diffuser-type endplate propeller of FIG. 5A in clockwise rotating along the X axis while viewing from the high pressure side. FIG. 5C is a diagram showing the inflow velocity at the cylindrical endplate for a conventional propeller without diffuser-type endplate under an inclined-shaft inflow condition, wherein the propeller turns to the 0° circumferential position. FIG. 5D is a diagram showing the inflow velocity at the endplate for the diffuser-type endplate propeller of FIG. 5A, wherein the propeller turns to the 0° circumferential position. FIG. 5E is a diagram showing the inflow velocity at the cylindrical endplate for a conventional propeller under an inclined-shaft inflow condition, wherein the propeller turns to the 180° circumferential position. FIG. 5F is a diagram showing the inflow velocity at the endplate for the diffuser-type endplate propeller of FIG. 5A, wherein the propeller turns to the 180° circumferential position. In FIGS. 5C to 5F, although the endplates 124 and 220 are curved plates and the inflow also flows along the curved plates, the curved plates and the curved inflow are stretched to be flat for better visualization and explanation, so the endplates 124 and 220 are depicted as straight plates. Referring to FIG. 5A, the actual experiments prove when the diffuser-type endplate propeller 100 rotates under an inclined-shaft condition, the diffuser-type endplate 124 not only prevents the water flow of the high-pressure side-surface from flowing to the low-pressure side-surface, but also eliminates the sheet cavitation phenomenon produced by the endplates 124 themselves regardless of the propeller blades 120 turning to any angle positions.

In more details, the axis L of the propeller hub 110 has an inclined-shaft angle φ towards the sailing direction A2 of the hull, in which the inclined-shaft angle φ ranges, for example, between 1° and 12°, and the propeller is suitable for a high-speed boat and ship with transom stern. The hull 20 in sailing produces a propeller inflow V1, in which the propeller inflow V1 enters the diffuser-type endplate propeller 100 in a direction opposite to the sailing direction A2, and the propeller inflow V1 has an included angle towards the axis L, i.e. the inclined-shaft angle φ. The propeller inflow V1 can be resolved into a first inflow component V1 cos φ parallel to the axis L and a second inflow component V1 sin φ vertical to the axis L. The second inflow component V1 sin φ enables the endplate 124 turning to the 0° circumferential position to increase the actual angle of attack of endplate or to the 180° circumferential position to decrease the actual angle of attack of endplate.

As shown by FIGS. 5B-5F, the diffuser-type endplate propeller 100 rotates in a peripheral velocity ωR around the X axis, wherein the peripheral velocity ωR produces an opposite cylindrical tangential inflow velocity ωR1 and the peripheral velocity ωR is equal to the cylindrical tangential inflow velocity ωR1. When the blade 120 turns to the 0° circumferential position, the cylindrical tangential inflow velocity ωR1 and the second inflow component V1 sin φ together form a first actual angle of attack of endplate α1 produced by the inclined-shaft inflow at the diffuser-type endplate 124 (as shown in FIG. 5D). It should be noted that, under the same condition, for a conventional un-contracted and diffused cylindrical endplate 220 (as shown in FIG. 5C), the cylindrical tangential inflow velocity ωR1 and the second inflow component V1 sin φ together form a first cylindrical endplate angle of attack α11 produced by the inclined-shaft inflow at the cylindrical endplate 220, in which the first cylindrical endplate angle of attack α11 is larger than the first actual angle of attack of endplate α1 of the diffused endplate in absolute value. For illustration, the outer-surface 220*d* and the inner-surface 220*c* of the conventional endplate 220 are shown in FIGS. 5C and 5E, the conventional endplate 220 is not contracted type and is also not diffused type.

As shown in FIG. 5D, the geometry of the diffused endplate has a negative angle α, the first actual angle of attack of endplate α1 is significantly smaller than the first cylindrical endplate angle of attack α11. Thus, the sheet cavitation of the endplate can be reduced or eliminated.

On the other hand, when the blade 120 turns to the 180° circumferential position, the cylindrical tangential inflow velocity ωR1 and the second inflow component V1 sin φ together form a second actual angle of attack of endplate α2 produced by the inclined-shaft inflow at the endplate 124 (as shown in FIG. 5F). It should be noted that, under the same condition, for a conventional un-contracted and diffused cylindrical endplate 220 (as shown in FIG. 5E), the cylindrical tangential inflow velocity ωR1 and the second inflow component V1 sin φ together form a second cylindrical endplate angle of attack α22 produced by the inclined-shaft inflow at the cylindrical endplate 220, in which the second cylindrical endplate angle of attack α22 is negative. Specifically, the first cylindrical endplate angle of attack α11 and the second cylindrical endplate angle of attack α22 have the same absolute values but they are positive and negative respectively. Since, in the diffuser-type endplate propeller 100 of the invention, the angle of attack of endplate α of the endplate 124 of the blade 120 has a negative value by design, so that when the blade 120 turns to the 0° circumferential position, the first actual angle of attack of endplate α1 of the endplate 124 is less than the first cylindrical endplate angle of attack of endplate α11 by an absolute value of the angle of attack of endplate α, and the decreased actual angle of attack of the endplate 124 reduces the sheet cavitation phenomenon produced at the low-pressure side-surface (the outer-surface 124*d* of the endplate 124).

In addition, when the blade 120 turns to the 180° circumferential position, although the second actual angle of attack of endplate α2 caused by the inclined-shaft inflow is negative and the angle of attack of endplate α of the endplate 124 is also negative by design so as to increase the included angle (negative one) between the actual inflow and the endplate 124 at the time and to make the pressure at the inner-surface 124*c* of the endplate 124 lower than the pressure at the outer-surface 124*d* of the endplate 124. However, the inner-surface 124*c* of the endplate 124 contacts the high-pressure side-surface of the blades of the propeller and the immerged depth of the endplate 124 at the 180° circumferential position is deeper, therefore, no cavitation phenomenon occurs which thus suppresses the vibration and noise induced by the propeller.

It should be noted here, the angle of attack of endplate α is an angle of attack of the endplate by design and determined based on the geometry of the endplate. However, the first actual angle of attack of endplate α1, the first cylindrical endplate angle of attack α11, the second actual angle of attack of endplate α2, and the second cylindrical endplate angle of attack α22 are determined based on the relative position between the endplate and the flow.

Figure 6A:
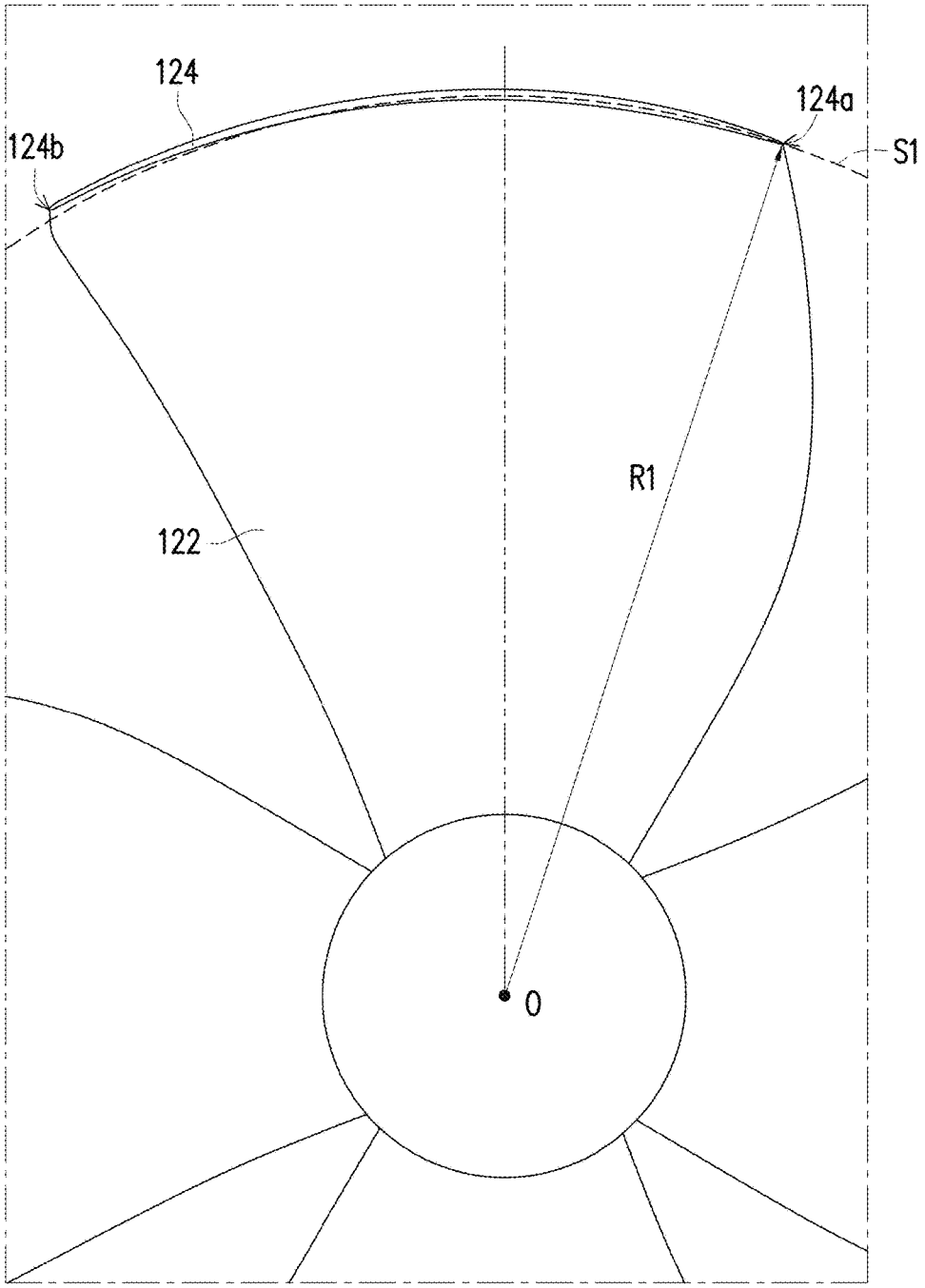
FIG. 6A is a partial enlarged view diagram of endplate having angle of attack of −1° when turning to the 0° circumferential position in one embodiment of the invention.
Figure 6B:
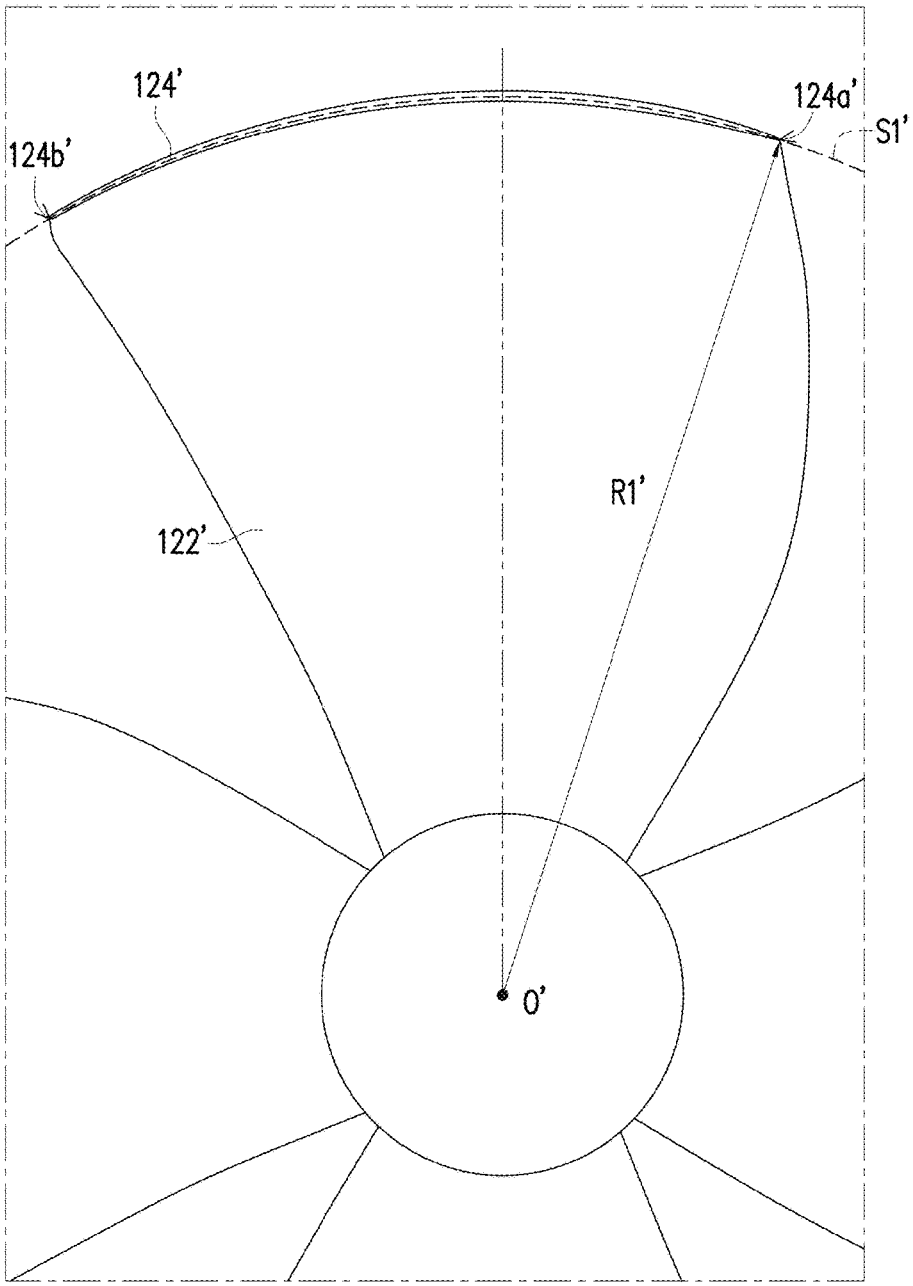
FIG. 6B (RELATED ART)
FIG. 6B is a partial enlarged view diagram of endplate having angle of attack of 0° when turning to the 0° circumferential position in conventional technology.
Figure 6C:
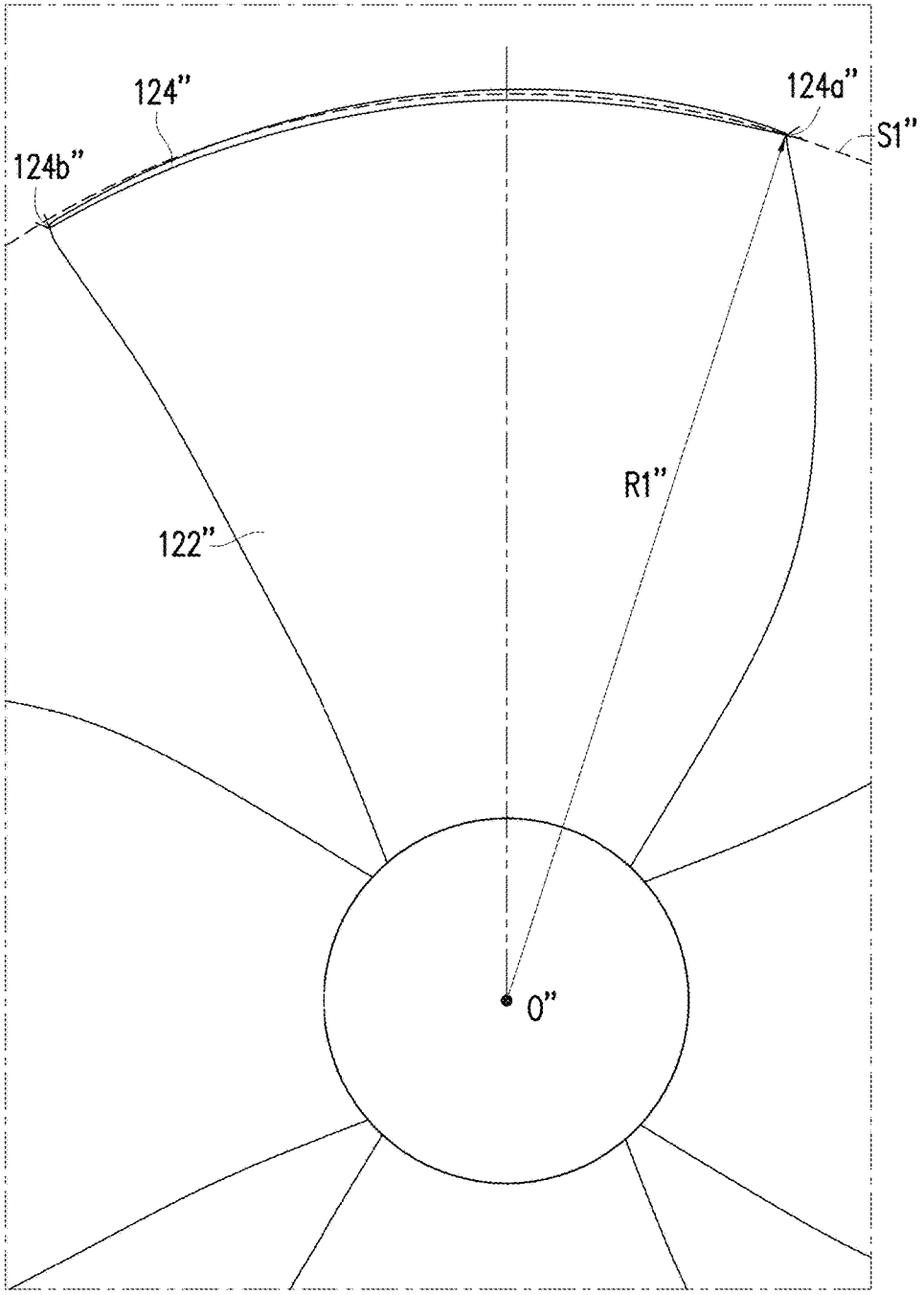
FIG. 6C (RELATED ART)
FIG. 6C is a partial enlarged view diagram of endplate having angle of attack of 1° when turning to the 0° circumferential position in conventional technology.

For clarification, the differences between three situations that the angle of attack of endplate α is equal to −1, 0°, and 1° are described hereinafter. FIG. 6A is a partial enlarged view diagram of endplate having angle of attack of −1° when turning to the 0° circumferential position in one embodiment of the invention, FIG. 6B is a partial enlarged view diagram of endplate having angle of attack of 0° when turning to the 0° circumferential position in conventional technology, and FIG. 6C is a partial enlarged view diagram of endplate having angle of attack of 1° when turning to the 0° circumferential position in conventional technology. Referring to FIG. 6A, the rotating track of the leading edge 124*a* forms the cylindrical surface S1 having radius R1 from the centre O of the diffuser-type endplate propeller. As clearly shown in FIG. 6A, when the angle of attack of the endplate 124 is equal to −1°, the leading edge 124*a* of the endplate 124 is located on the cylindrical surface S1 and the trailing edge 124*b* of the endplate 124 is located outside of the cylindrical surface S1.

Referring to FIG. 6B of the conventional technology, similarly, the rotating track of the leading edge 124*a*' forms the cylindrical surface S1' having radius R1' from the centre O' of the endplate propeller. In FIG. 6B, the angle of attack of the endplate 124' is equal to 0°, the leading edge 124*a*' and the trailing edge 124*b*' of the endplate 124' are located on the cylindrical surface S1'. On the other hand, referring to FIG. 6C of the conventional technology, similarly, the rotating track of the leading edge 124*a*" forms the cylindrical surface S1" having radius R1" from the centre O" of the endplate propeller. In FIG. 6C, the angle of attack of the endplate 124" is equal to 1°, the leading edge 124*a*" of the endplate 124" is located on the cylindrical surface S1" and the trailing edge 124*b*" of the endplate 124" is located inside of the cylindrical surface S1". Based on the above, the differences in geometry be design of the endplates having angle of attacks of −1°, 0°, and 1° are clearly shown.

Figure 7A:
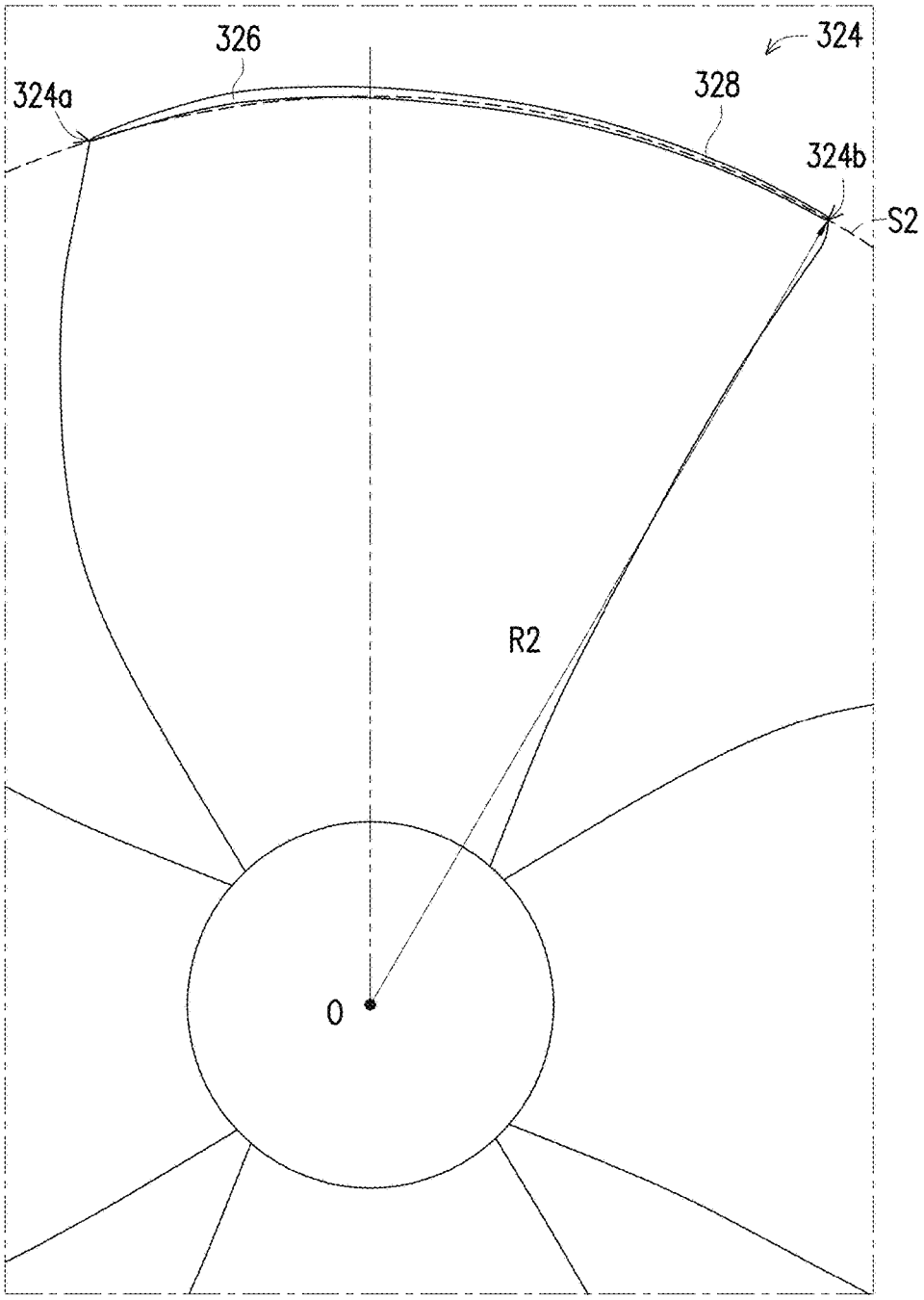
FIG. 7A is a partial enlarged view diagram of endplate having a local positive camber distribution near the leading edge of the endplate compared with a cylindrical surface when turning to the 0° circumferential position in another embodiment of the invention.

FIG. 7A is a partial enlarged view diagram of endplate having a positive camber distribution near the leading edge of the endplate compared with a cylindrical surface when turning to the 0° circumferential position in another embodiment of the invention. In the present embodiment of FIG. 7A, the endplate 324 has a first portion 326 and a second portion 328, the leading edge 324*a* is located at the first portion 326, and the trailing edge 324*b* is located at the second portion 328. The distance from the leading edge 324*a* to the centre O of the diffuser-type endplate propeller is equal to the distance from the trailing edge 324*b* to the centre O of the diffuser-type endplate propeller and is represented as R2. That is to say, the leading edge 324*a* and the trailing edge 324*b* are both located on the cylindrical surface S2 which has centre O and radius R2. However, the curvature of the first portion 326 is greater than the curvature of the second portion 328, so the angle of attack of the endplate 324 at the leading edge 324*a* is greater than or equal to −1° and smaller than 0° by the designed geometry. In the present embodiment, the length of the first portion 326 is equal to the length of the second portion 328 and equal to a half of the length of the endplate 324, and the first portion 326 has a positive camber distribution. However, the invention is not limited thereto, the ratio of the length of the first portion 326 to the total length of the endplate 324 may be greater than zero and smaller than or equal to 1, as long as the angle of attack of the endplate 324 at the leading edge 324*a* is greater than or equal to −1° and smaller than 0°.

Figure 7B:
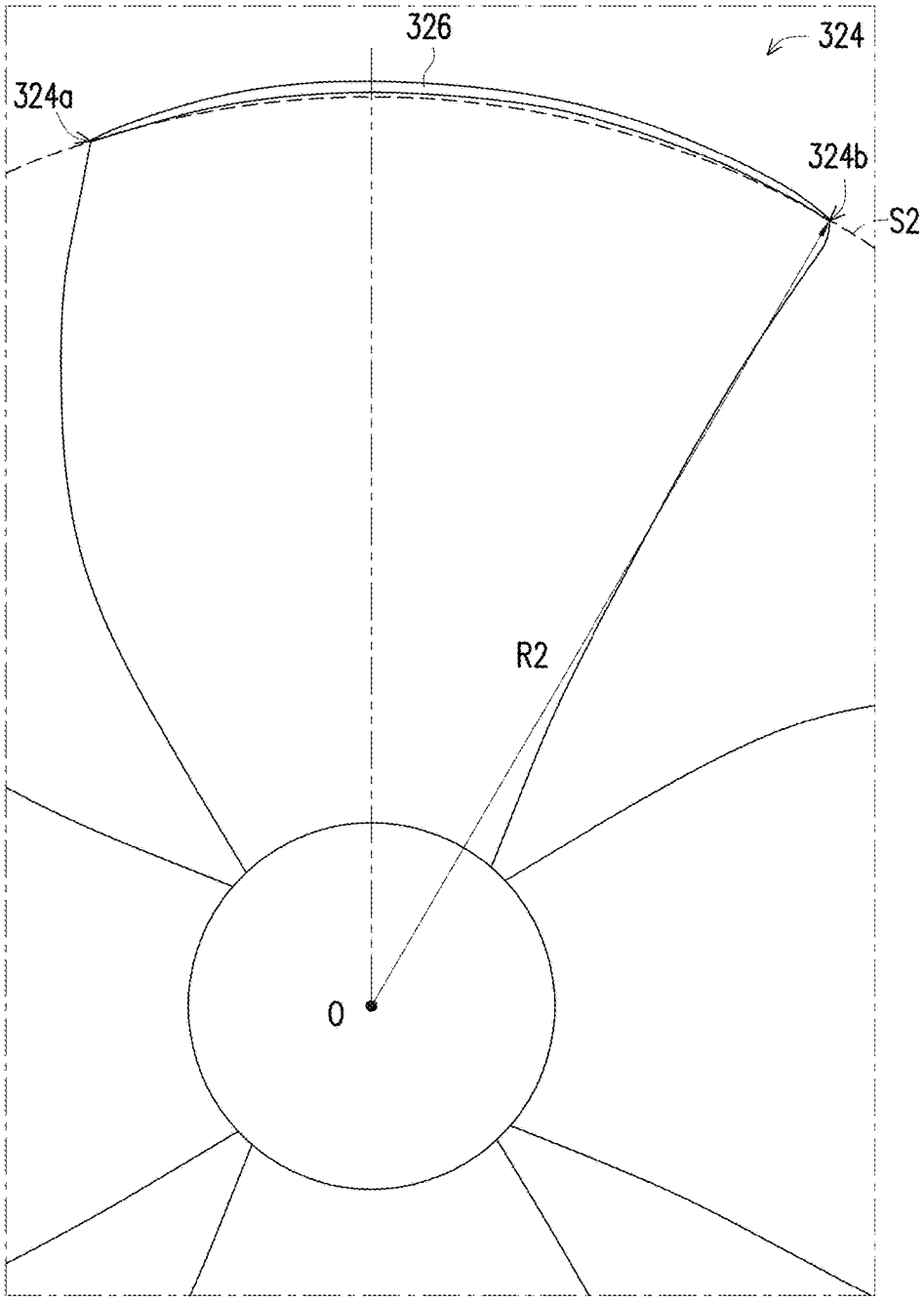
FIG. 7B is a partial enlarged view diagram of endplate having a positive camber distribution on the endplate compare with the cylindrical surface when turning to the 0° circumferential position in another embodiment of the invention.

FIG. 7B is a partial enlarged view diagram of endplate having a positive camber distribution on the endplate compared with the cylindrical surface when turning to the 0° circumferential position in another embodiment of the invention. In the present embodiment, the leading edge 324*a* and the trailing edge 324*b* are still located on the cylindrical surface S2, the first portion 326 has a positive camber distribution, and the length of the first portion 326 is equal to the total length of the endplate 324. In other words, the ratio of the length of the first portion 326 to the total length of the endplate 324 is equal to 1.0. That is to say, the geometry of the endplate 324 is a camber in comparison with the cylindrical surface S2. In addition, the camber 324 can provide the same effect of the diffused type endplate. To be more specific, the camber 324 can also largely reduce and even eliminate the serious extent of cavitation on the outer side of the camber 324 itself when operating at inclined-shaft condition or a horizontal shaft condition.

Figure 8:
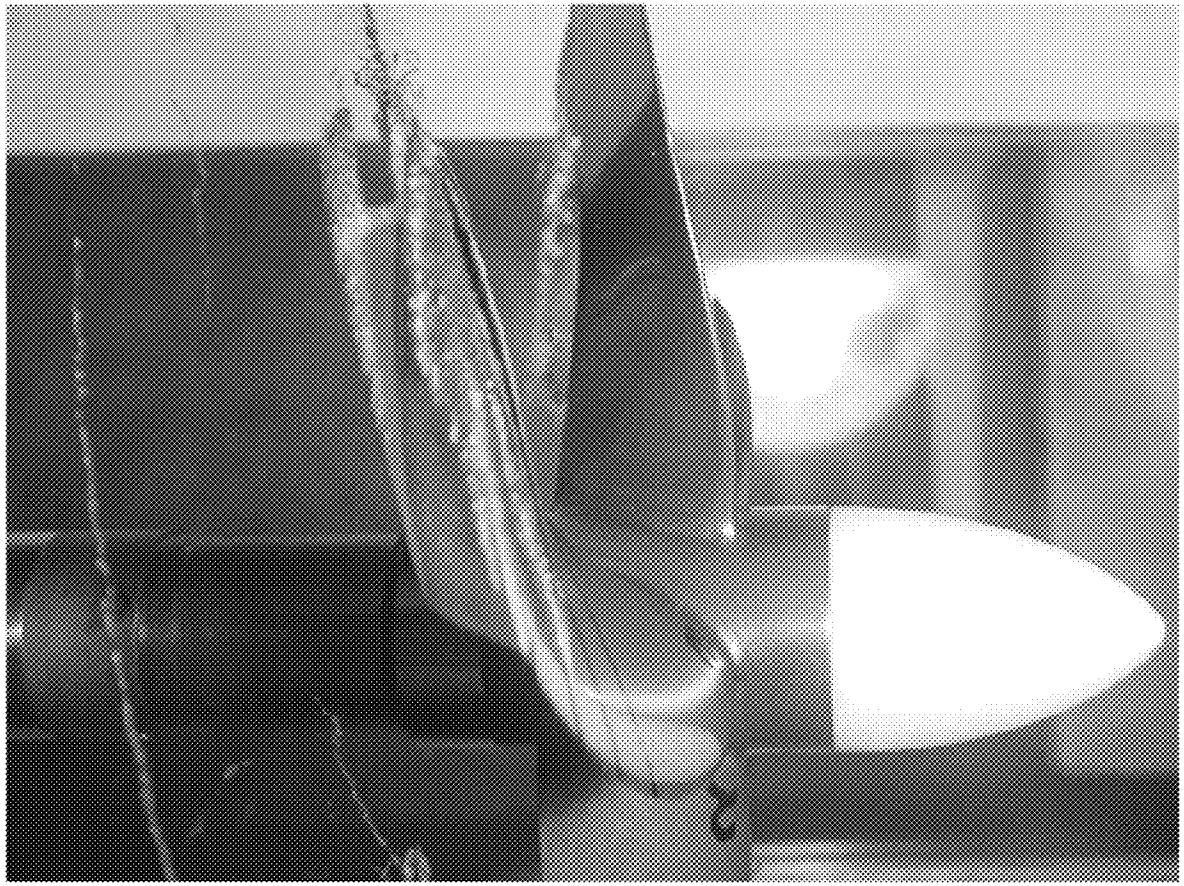
FIG. 8 is a top view showing experimental result of a conventional CLT propeller.

FIG. 8 is a top view showing experimental result of a conventional CLT propeller. In the experiment shown in FIG. 8, the endplate is contracted type, the angle of attack of the endplate is +0.1°, the inclined shaft angle is 10°, the cavitation number is 1.5, and the sheet cavitation phenomenon produced at the outer-sides of the endplate when the blade turns to the 0° circumferential position is very serious.

Figure 9A:
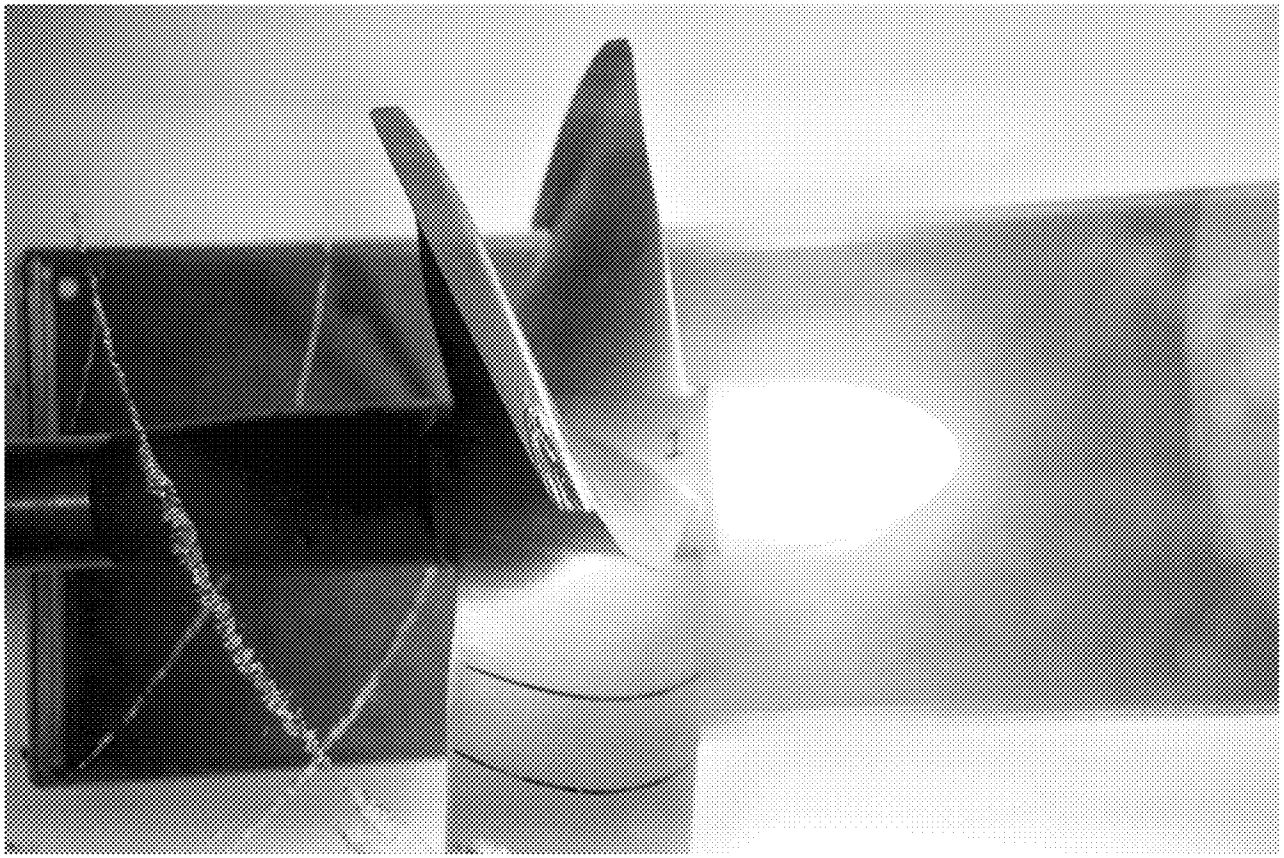
FIG. 9A is a top view showing experimental result of a first diffuser-type endplate propeller of one embodiment of the invention.

FIG. 9A is a top view showing experimental result of a first diffuser-type endplate propeller of one embodiment of the invention. In the experiment shown in FIG. 9A, the endplate is diffused type, the angle of attack of the endplate is −0.1°, the inclined shaft angle is 8°, the cavitation number is 1.0, and the sheet cavitation phenomenon produced at the outer-sides of the endplate is reduced.

Figure 9B:
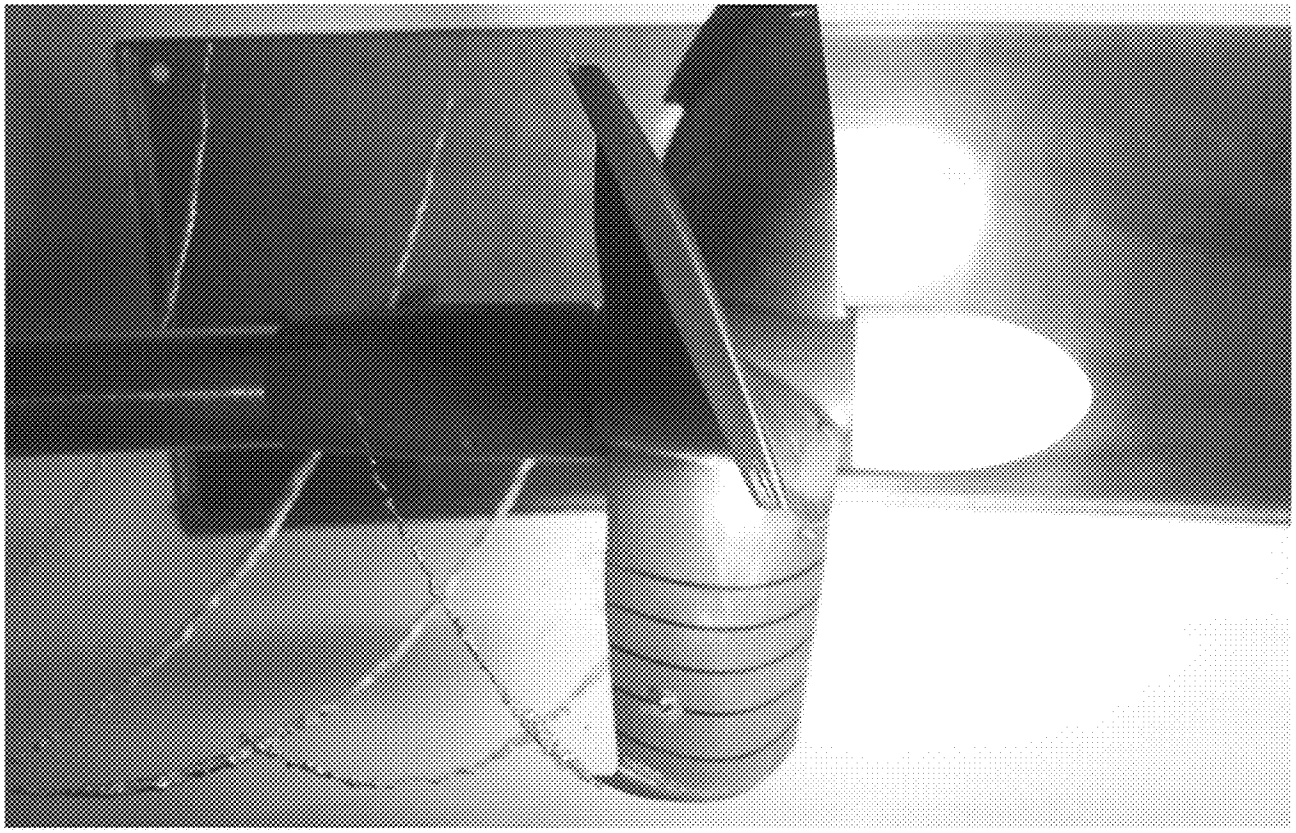
FIG. 9B is a top view showing experimental result of a second diffuser-type endplate propeller of another embodiment of the invention.

FIG. 9B is a top view showing experimental result of a second diffuser-type endplate propeller of another embodiment of the invention. In the experiment shown in FIG. 9B, the endplate is diffused type, the angle of attack of the endplate is −1°, the inclined shaft angle is 8°, the cavitation number is 1.0, and the sheet cavitation phenomenon produced at the outer-sides of the endplate is greatly reduced.

Figure 9C:
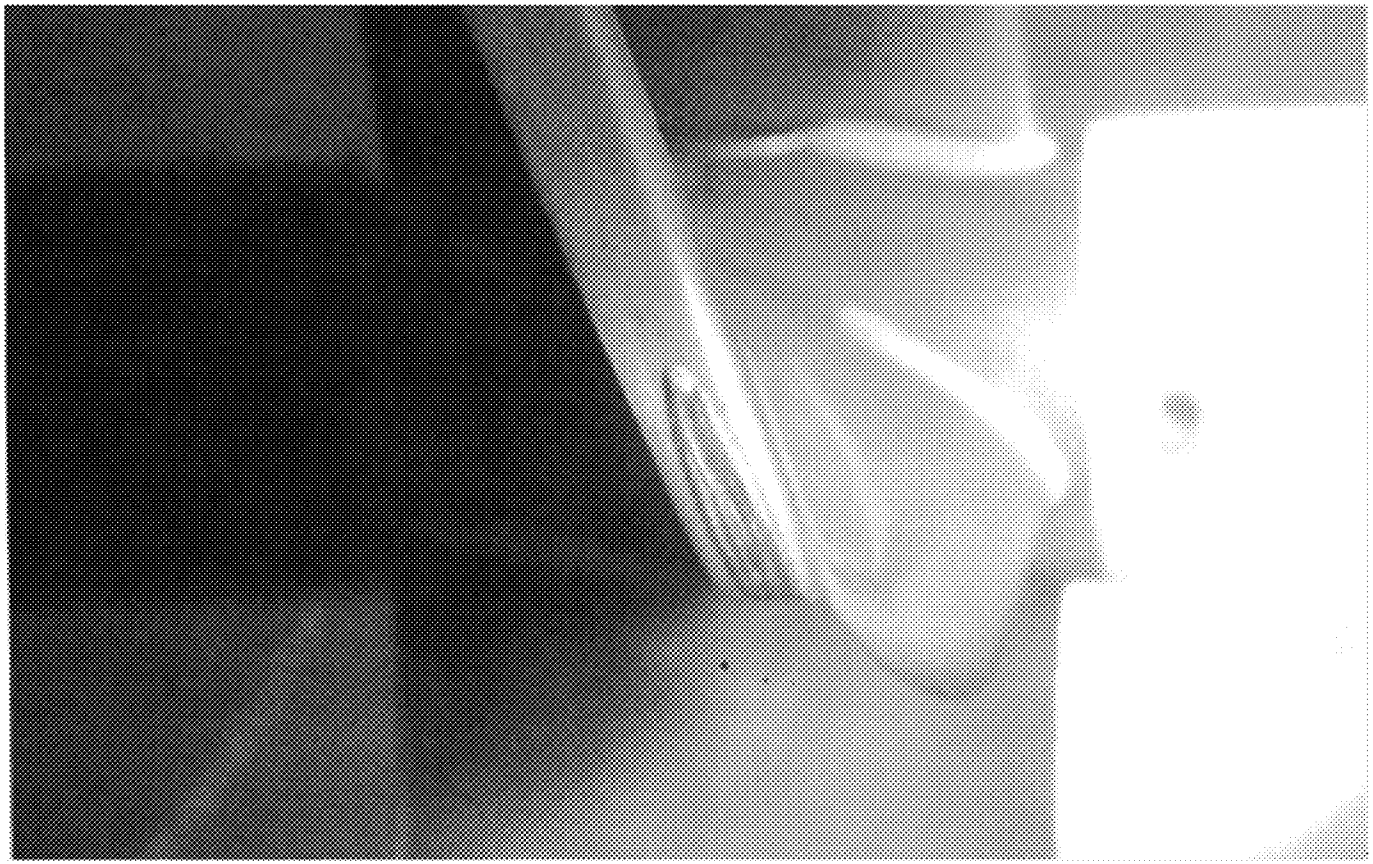
FIG. 9C is a top view showing experimental result of a third diffuser-type endplate propeller of yet another embodiment of the invention.

FIG. 9C is a top view showing experimental result of a third diffuser-type endplate propeller of yet another embodiment of the invention. In the experiment shown in FIG. 9C, the endplate is also diffused type, the angle of attack of the endplate is −0.8°, the inclined shaft angle is 8°, the cavitation number is 1.0, and the sheet cavitation phenomenon produced at the outer-sides of the endplate is further reduced compared to the first diffuser-type endplate propeller.

The first, the second, and the third diffuser-type endplate propellers are similar and the only difference is the angle of attack of the endplate. Each of the first, the second, and the third diffuser-type endplate propellers has four blades and developed area ratio of 0.8.

Figure 9D:
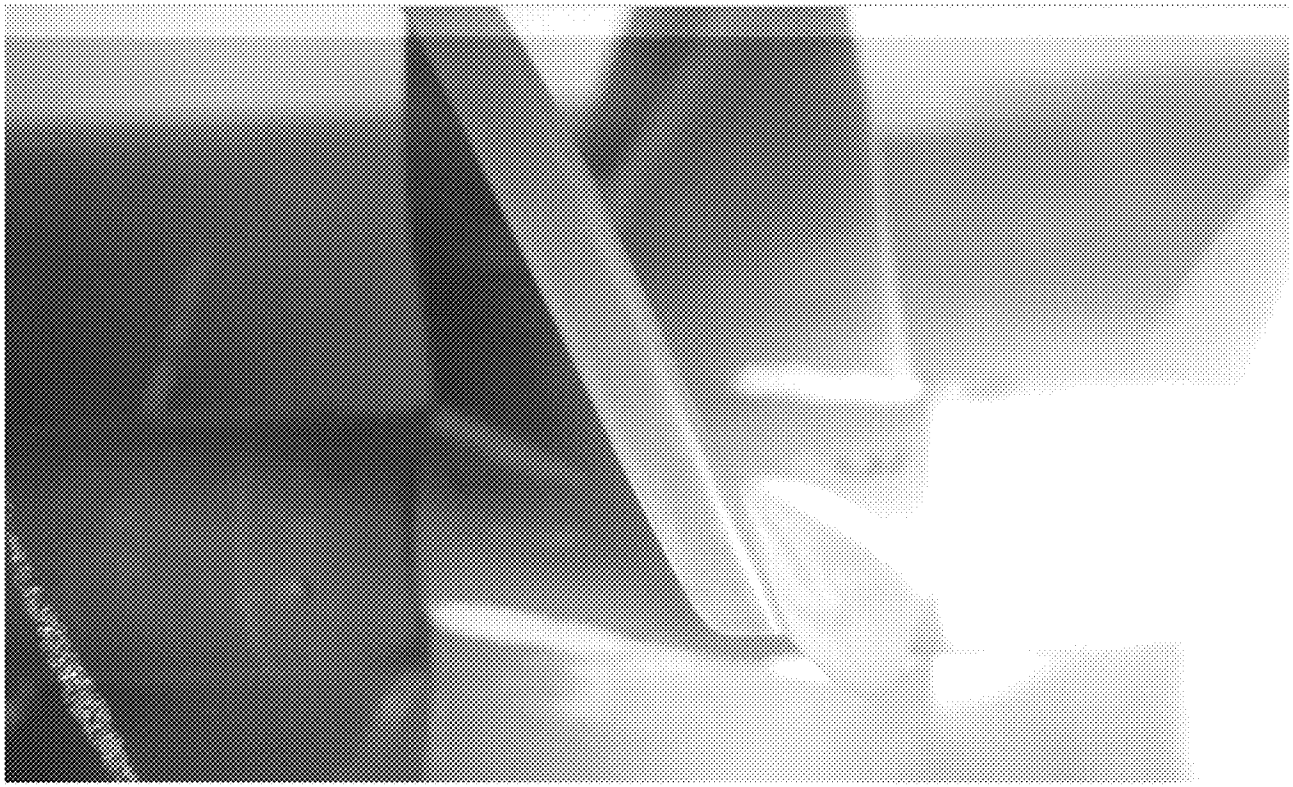
FIG. 9D is a top view showing experimental result of a fourth diffuser-type endplate propeller of yet another embodiment of the invention.

FIG. 9D is a top view showing experimental result of a fourth diffuser-type endplate propeller of yet another embodiment of the invention. In the experiment shown in FIG. 9D, the endplate is also diffused type, the developed area ratio is 1.0, the angle of attack of the endplate is −1°, the inclined shaft angle is 8°, the cavitation number is 1.0, and the sheet cavitation phenomenon produced at the outer-sides of the endplate is eliminated.

Figure 9E:
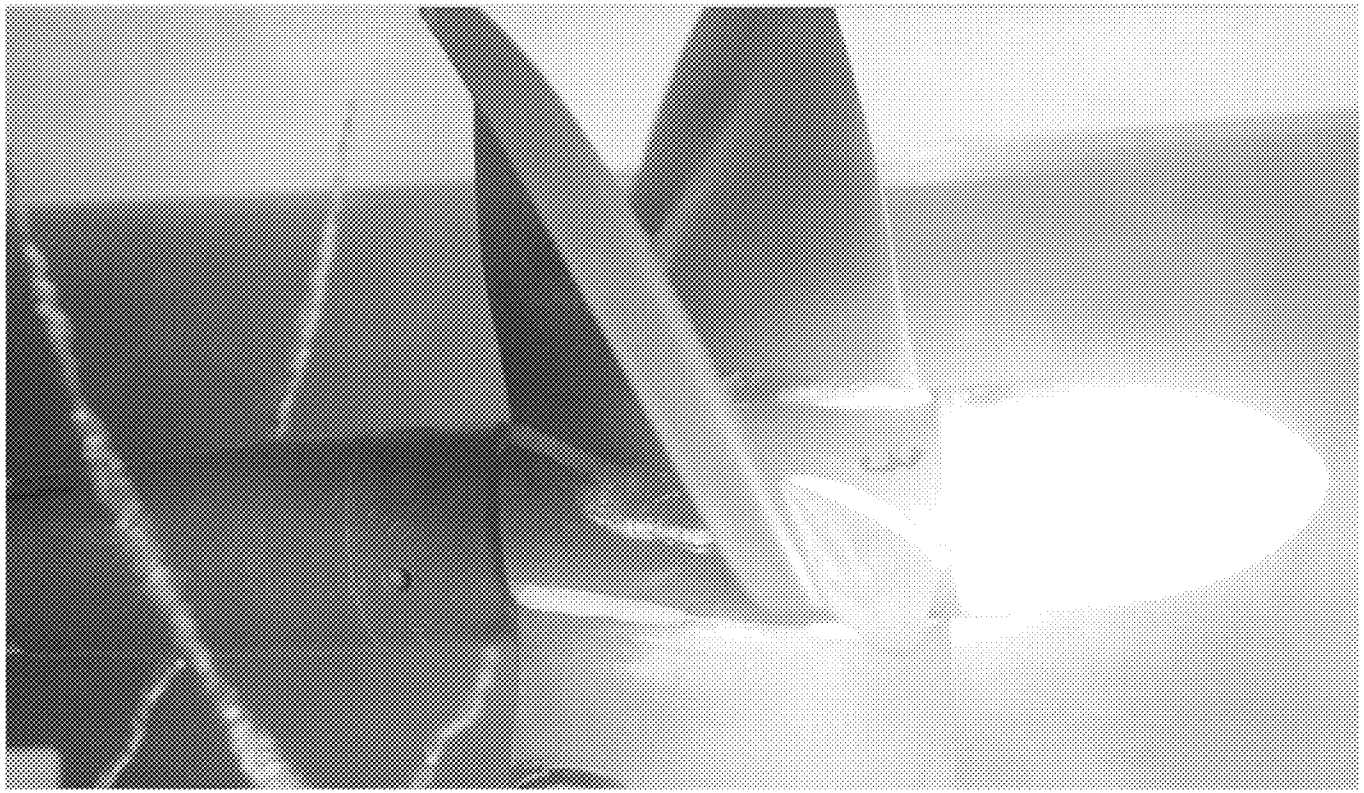
FIG. 9E is a top view showing experimental result of a fifth diffuser-type endplate propeller of yet another embodiment of the invention.

FIG. 9E is a top view showing experimental result of a fifth diffuser-type endplate propeller of yet another embodiment of the invention. In the experiment shown in FIG. 9E, the endplate is also diffused type, the developed area ratio is 1.0, the angle of attack of the endplate is −1°, the inclined shaft, angle is 8°, the cavitation number is 0.75, and the sheet cavitation phenomenon produced at the outer-sides of the endplate is also eliminated. Therefore, the greater the developed area ratio is, the more effective/the greater the sheet cavitation is reduced.

Figure 9F:
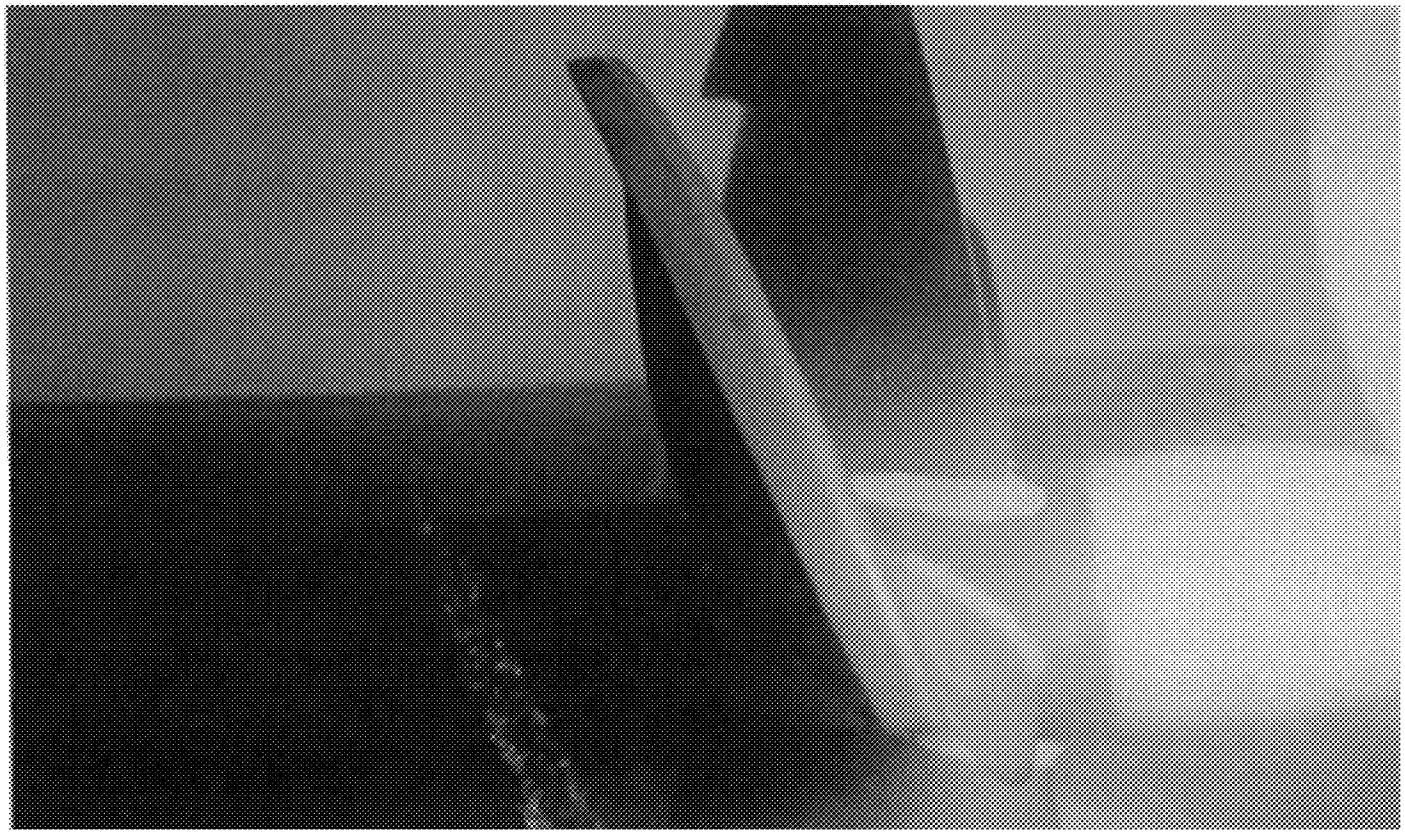
FIG. 9F is a top view showing experimental result of a sixth diffuser-type endplate propeller with five blades of yet another embodiment of the invention.

FIG. 9F is a top view showing experimental result of a sixth diffuser-type endplate propeller with five blades of yet another embodiment of the invention. In the experiment shown in FIG. 9F, the endplate is also diffused type, the developed area ratio is 1.0, the angle of attack of the endplate is −0.8°, the inclined shaft angle is 10°, the cavitation number is 1.0, and the sheet cavitation phenomenon produced at the outer-sides of the endplate is also eliminated.

Figure 9G:
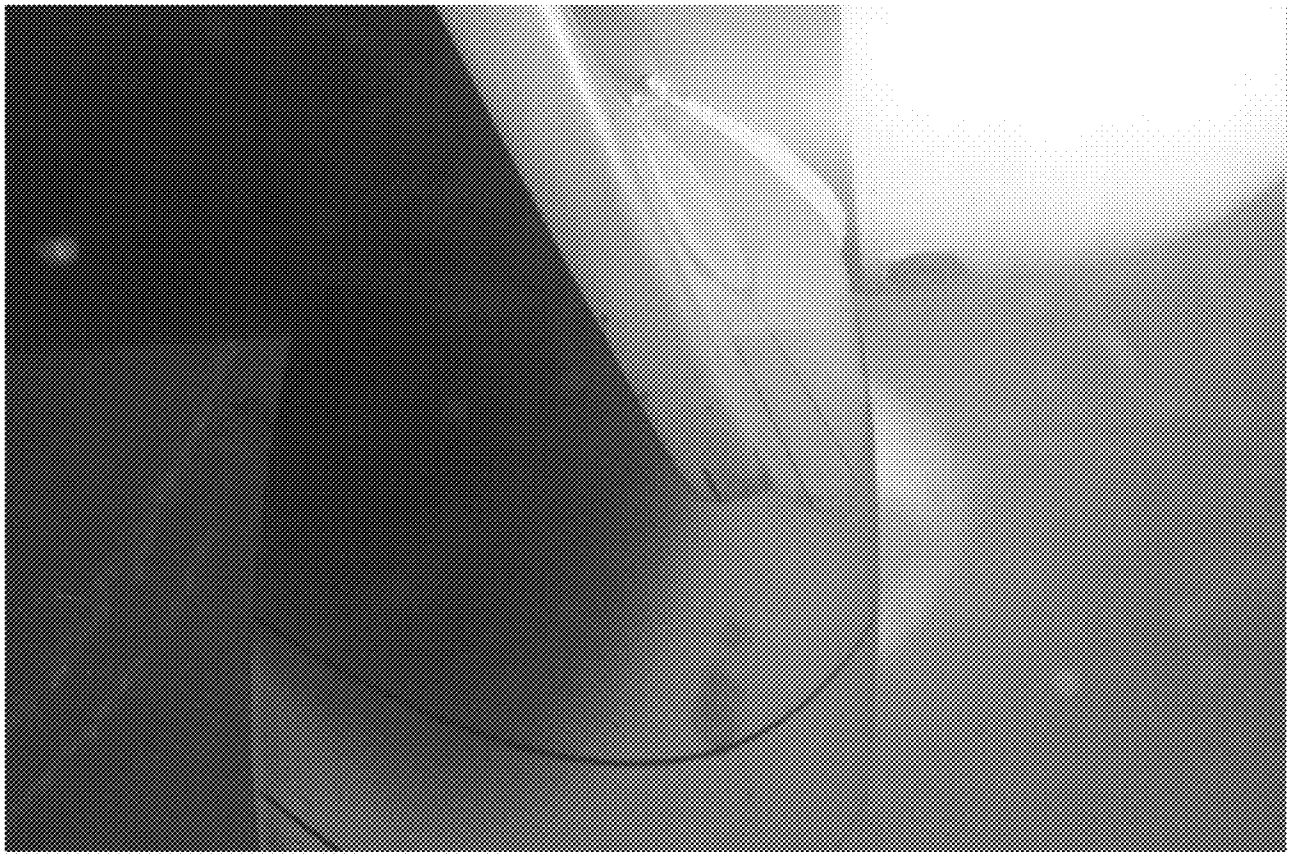
FIG. 9G is a top view showing experimental result of a seventh diffuser-type endplate propeller with four blades of yet another embodiment of the invention.

Finally, FIG. 9G is a top view showing experimental result of a seventh diffuser-type endplate propeller with four blades of yet another embodiment of the invention. In the experiment shown in FIG. 9G, the endplate is also diffused type, the developed area ratio is 1.0, the angle of attack of the endplate is −0.8°, the inclined shaft angle is 10°, the cavitation number is 1.0, and the sheet cavitation phenomenon produced at the outer-sides of the endplate is also eliminated. The above-mentioned experiments are conducted at the cavitation tunnel of the National Taiwan Ocean University, Keelung, Taiwan.

In summary, not only can the diffuser-type endplate propeller of the invention prevent the flow at the high-pressure side-surface from back-flowing to the low-pressure side-surface, the diffuser-type endplate propeller of the invention can also largely reduce and even eliminate the serious extent of cavitation on the outer side of the endplate itself when operating at inclined-shaft condition. As a result, the invention can significantly improve the efficiency of the propeller and largely reduce the vibration and noise produced by the propeller.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A diffuser-type endplate propeller, configured to drive a hull and comprising:

a propeller hub, having an axis of rotation of the diffuser-type endplate propeller and connected to a transmission shaft of the hull; and a plurality of blades, respectively having a blade-body and an endplate, wherein each of the blade-bodies is connected to the propeller hub and extends outward from the propeller hub to the corresponding endplate, each of the endplates bends from the corresponding blade-body to extend towards a stern of the hull, each of the endplates has a leading edge and a trailing edge, wherein a cylindrical surface is imaginarily formed by the leading edges while the diffuser-type endplate propeller is rotated about the axis, wherein each of the endplates has a first tangent plane at the leading edge thereof, the cylindrical surface has a second tangent plane at the leading edge, wherein, while viewing from a high-pressure side of the diffuser-type endplate propeller, the diffuser-type endplate propeller rotates clockwise to drive the hull for proceeding towards a sailing direction, and an included angle between the first tangent plane and the second tangent plane is a negative angle measured from the second tangent plane to the first tangent plane, and wherein the included angle is greater than or equal to −1° and smaller than 0°.

2. The diffuser-type endplate propeller according to claim 1, wherein the leading edge keeps a first distance from the axis of the propeller hub, the trailing edge keeps a second distance from the axis of the propeller hub, and the first distance is shorter than the second distance.

3. The diffuser-type endplate propeller according to claim 1, wherein the axis of the propeller hub is not parallel to the sailing direction.

4. The diffuser-type endplate propeller according to claim 1, which is integrally molded.

5. A diffuser-type endplate propeller, configured to drive a hull and comprising:

a propeller hub, having an axis of rotation of the diffuser-type endplate propeller and connected to a transmission shaft of the hull; and a plurality of blades, respectively having a blade-body and an endplate, wherein each of the blade-bodies is connected to the propeller hub and extends outward from the propeller hub to the corresponding endplate, each of the endplates bends from the corresponding blade-body to extend towards a stern of the hull, each of the endplates has a leading edge and a trailing edge, wherein a cylindrical surface is imaginarily formed by the leading edges while the diffuser-type endplate propeller is rotated about the axis, wherein each of the endplates has a first tangent plane at the leading edge thereof, the cylindrical surface has a second tangent plane at the leading edge, wherein, while viewing from a high-pressure side of the diffuser-type endplate propeller, the diffuser-type endplate propeller rotates clockwise to drive the hull for proceeding towards a sailing direction, and an included angle between the first tangent plane and the second tangent plane is a negative angle measured from the second tangent plane to the first tangent plane, wherein the leading edge keeps a first distance from the axis of the propeller hub, the trailing edge keeps a second distance from the axis of the propeller hub, and the first distance is equal to the second distance, and wherein each of the endplates comprise a first portion and a second portion, the leading edge is located at the first portion and the trailing edge is located at the second portion, and a curvature of the first portion is greater than a curvature of the second portion.

6. The diffuser-type endplate propeller according to claim 5, wherein the included angle is greater than or equal to −1° and smaller than 0°.

7. The diffuser-type endplate propeller according to claim 5, wherein the axis of the propeller hub is not parallel to the sailing direction.

8. The diffuser-type endplate propeller according to claim 5, which is integrally molded.

9. A diffuser-type endplate propeller, configured to drive a hull and comprising:

a propeller hub, having an axis of rotation of the diffuser-type endplate propeller and connected to a transmission shaft of the hull; and a plurality of blades, respectively having a blade-body and an endplate, wherein each of the blade-bodies is connected to the propeller hub and extends outward from the propeller hub to the corresponding endplate, each of the endplates bends from the corresponding blade-body to extend towards a stern of the hull, each of the endplates has a leading edge and a trailing edge, wherein a cylindrical surface is imaginarily formed by the leading edges while the diffuser-type endplate propeller is rotated about the axis, wherein each of the endplates has a first tangent plane at the leading edge thereof, the cylindrical surface has a second tangent plane at the leading edge, wherein, while viewing from a high-pressure side of the diffuser-type endplate propeller, the diffuser-type endplate propeller rotates counter-clockwise to drive the hull for proceeding towards a sailing direction, and an included angle between the first tangent plane and the second tangent plane is a positive angle measured from the second tangent plane to the first tangent plane, and wherein the included angle is greater than 0° and smaller than or equal to 1°.

10. The diffuser-type endplate propeller according to claim 9, wherein the leading edge keeps a first distance from the axis of the propeller hub, the trailing edge keeps a second distance from the axis of the propeller hub, and the first distance is shorter than the second distance.

11. The diffuser-type endplate propeller according to claim 9, wherein the axis of the propeller hub is not parallel to the sailing direction.

12. The diffuser-type endplate propeller according to claim 9, which is integrally molded.

13. A diffuser-type endplate propeller, configured to drive a hull and comprising:

a propeller hub, having an axis of rotation of the diffuser-type endplate propeller and connected to a transmission shaft of the hull; and a plurality of blades, respectively having a blade-body and an endplate, wherein each of the blade-bodies is connected to the propeller hub and extends outward from the propeller hub to the corresponding endplate, each of the endplates bends from the corresponding blade-body to extend towards a stern of the hull, each of the endplates has a leading edge and a trailing edge, wherein a cylindrical surface is imaginarily formed by the leading edges while the diffuser-type endplate propeller is rotated about the axis, wherein each of the endplates has a first tangent plane at the leading edge thereof, the cylindrical surface has a second tangent plane at the leading edge, wherein, while viewing from a high-pressure side of the diffuser-type endplate propeller, the diffuser-type endplate propeller rotates counter-clockwise to drive the hull for proceeding towards a sailing direction, and an included angle between the first tangent plane and the second tangent plane is a positive angle measured from the second tangent plane to the first tangent plane, wherein the leading edge keeps a first distance from the axis of the propeller hub, the trailing edge keeps a second distance from the axis of the propeller hub, and the first distance is equal to the second distance, and wherein each of the endplates comprise a first portion and a second portion, the leading edge is located at the first portion and the trailing edge is located at the second portion, and a curvature of the first portion is greater than a curvature of the second portion.

14. The diffuser-type endplate propeller according to claim 13, wherein the included angle is greater than 0° and smaller than or equal to 1°.

15. The diffuser-type endplate propeller according to claim 13, wherein the axis of the propeller hub is not parallel to the sailing direction.

16. The diffuser-type endplate propeller according to claim 13, which is integrally molded.

* * * * *